US008831452B2

(12) United States Patent
Yamada

(10) Patent No.: US 8,831,452 B2
(45) Date of Patent: Sep. 9, 2014

(54) IMAGE FORMING APPARATUS WITH TRANSFER VOLTAGE DETECTION

(75) Inventor: Toshiyuki Yamada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 12/873,686

(22) Filed: Sep. 1, 2010

(65) Prior Publication Data

US 2011/0069979 A1 Mar. 24, 2011

(30) Foreign Application Priority Data

Sep. 18, 2009 (JP) ..... 2009-216953

(51) Int. Cl.
*G03G 15/16* (2006.01)
*G03G 15/00* (2006.01)

(52) U.S. Cl.
USPC ..... 399/66; 399/44

(58) Field of Classification Search
USPC ..... 399/66, 310, 44, 314
See application file for complete search history.

(56) References Cited

U.S. PATENT DOCUMENTS

| | | | | |
|---|---|---|---|---|
| 6,996,350 | B2 | 2/2006 | Tomizawa | |
| 7,340,191 | B2 | 3/2008 | Yamada | |
| 7,450,871 | B2 | 11/2008 | Yamada | |
| 2002/0131785 | A1 * | 9/2002 | Ito | 399/44 |
| 2004/0005162 | A1 | 1/2004 | Tomizawa | |
| 2006/0204262 | A1 * | 9/2006 | Hayashida | 399/66 |
| 2008/0118259 | A1 | 5/2008 | Yamada | |

FOREIGN PATENT DOCUMENTS

| | | | |
|---|---|---|---|
| JP | 2000-75687 | A | 3/2000 |
| JP | 2004-86166 | A | 3/2004 |
| JP | 2008-129471 | A | 6/2008 |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes a photosensitive member; charging device for electrically charging the photosensitive member; an exposure device for exposing to light the photosensitive member to form an electrostatic latent image; a developing device for developing the electrostatic latent image into a toner image; a transfer member for forming a transfer portion at which the toner image is to be transferred from the photosensitive member onto a transfer material; a voltage control portion for controlling a transfer voltage to be applied to the transfer member so that a current passing through the transfer member is constant; and a current setting device for setting a current value in constant current control by the voltage control portion so that the current value is decreased when a ratio of a potential difference between the transfer voltage and a light portion potential provided by the exposure device to a potential difference between the transfer voltage and a dark portion potential provided by the exposure device is decreased and so that the current value is increased when the ratio is increased.

6 Claims, 14 Drawing Sheets

(a) FRESH (b) END OF LIFETIME (a) CONTRAST:600V (b) CONTRAST:300V (a) LOW HUMIDITY (b) HIGH HUMIDITY

IMAGE FORMING APPARATUS WITH TRANSFER VOLTAGE DETECTION

FIELD OF THE INVENTION AND RELATED ART

The present invention relates to an image forming apparatus in which a toner image is transferred from an image bearing member onto a transfer material (medium) by applying a voltage, which has been subjected to constant current control, to a transfer portion created by using a transfer member, and specifically relates to control for setting a current value in the constant current control depending on a change in resistance value of the transfer member.

The image forming apparatus in which the toner image is transferred from the image bearing member (a photosensitive member or an intermediary transfer member) onto the transfer material (the intermediary transfer member or a recording material) which passes through the transfer portion by applying the voltage to the transfer portion created by using the transfer member (a transfer roller, a transfer belt or the like) has been used widely.

As shown in FIG. 5, in order to transfer the toner image in a maximum amount from the image bearing member onto the transfer material, there is a need to control a current, which passes through the transfer material when the voltage is applied to the transfer portion, in a proper range. This is because a part of the toner image remains on the image bearing member without being transferred and thus a transfer efficiency is lowered in the case where the current is insufficient and the transfer efficiency is lowered by inversion of a charge polarity of the toner image by electric discharge to cause re-transfer of the toner image onto the image bearing member in the case where the current is excessive. Further, the control method of the voltage to be applied to the transfer portion is roughly classified into constant voltage control (Japanese Laid-Open Patent Application (JP-A) 2004-86166) and constant current control (JP-A 2000-75687).

In JP-A 2004-86166, a tandem type full-color printer in which the toner image is transferred from a photosensitive drum onto an intermediary transfer belt by applying the voltage, which has been subjected to the constant voltage control, to the transfer roller is shown. In this printer, a constant voltage is set, in advance of image formation, every image formation so that a predetermined current passes through the transfer portion even when the resistance value of the transfer roller is increased by cumulative transfer. Specifically, constant voltages at a plurality of stages are applied to the transfer portion during non-image formation to measure current values at the plurality of stages and a resultant plurality of voltage-current data is subjected to interpolating operation and then the constant voltage capable of providing the predetermined current is set.

In JP-A 2000-75687 a rotary development type full-color printer in which the toner image is transferred from photosensitive drum onto the recording material by applying the voltage, which has been subjected to the constant current control, to the transfer portion created by using the transfer belt is shown. In this printer, a constant current is set during the non-image formation so that a predetermined current passes through the recording material (image area) even when a width of the recording material is changed. Specifically, the width of the recording material is measured and the constant current is set at a larger value with a shorter length of the recording material along the transfer portion, so that a sufficient current is distributed to the recording material which is higher in resistance than that of the outside of the recording material. That is, in the case where the voltage, which has been subjected to the constant current control, is applied to a secondary transfer portion, when the current passing through the outside of the recording material is increased, the current which pass through the inside of the recording material and relates to the transfer is decreased. For this reason, it is possible to ensure the current, which passes through the inside of the recording material and relates to the transfer, at a constant level by setting the constant current at a higher value with a shorter length of the recording material along the transfer portion.

The resistance value of the transfer member largely varies depending on an ambient humidity, a material temperature and a cumulative number of sheets subjected to the image formation. For this reason, in the case where the voltage which has been subjected to the constant voltage control is applied, there is a need to set the constant voltage again so that the current is a certain range in which the transfer efficiency is high even when the resistance value of the transfer member is changed (JP-A 2004-86166).

In this regard, in the case of the constant current control, when the resistance value of the transfer member is changed, the voltage is automatically adjusted every moment so as to ensure the current in the certain range in which the transfer efficiency is high. For this reason, in the case of the constant current control, there is no need to effect control for remedying the change in partial voltage generated in a resistance of the transfer member as described in JP-A 2004-86166.

However, even in the case where the voltage which has been subjected to the constant current control is applied to the transfer portion, when the resistance value of the transfer member is changed, it has been found that a proper constant current range in which the transfer efficiency is high.

That is, in the case where an electrostatic image formed on the photosensitive member is reversely developed to form the toner image, as shown in FIGS. 3(*a*) and 3(*b*), a potential difference of several hundred volts (V) is provided between an exposed portion (light portion) which is an image portion at which the toner image is carried and a non-exposed portion (dark portion) which is a non-image portion at which the total impedance is not carried. Further, a voltage of an opposite polarity to the charge polarity of the toner image is applied to the transfer member so as to move the toner image to the transfer material (the intermediary transfer member or the recording material), so that the voltage, relating to the transfer, at the exposed portion where the toner image is carried is lower than that at the non-exposed portion where the toner image is not carried by a value corresponding to the potential difference of several hundred volts.

For this reason, the constant current, which passes through the exposed portion and the non-exposed portion, passes locally through the non-exposed portion in an amount corresponding to the potential difference of several hundred volts, so that a density of the current passing through the exposed portion where the toner image is actually transferred is lower than that at the non-exposed portion. Further, in order to ensure a sufficient current density at the exposed portion where the toner image is actually transferred, the constant current control is effected at a current value which is increased at the entire transfer portion, compared with that in the case where the entire transfer portion is the exposed portion, by an amount corresponding to the current which passes locally through the non-exposed portion.

For this reason, in the case where the constant current capable of providing a proper current density at the exposed portion when the resistance value of the transfer member is low is used as it is even in a state in which the resistance value of the transfer member is low, an excessive current passes through the exposed portion and thus the transfer efficiency is lowered. This is because when the resistance value of the transfer member is high, a high voltage is applied to the transfer portion and therefore a degree of localization of the current due to the potential difference of several hundred volts between the non-exposed portion and the exposed portion is relatively small.

On the other hand, in the case where the constant current capable of providing a proper current density at the exposed portion when the resistance value of the transfer member is high is used as it is even in a state in which the resistance value of the transfer member is low, the current passes through the exposed portion is insufficient and thus the transfer efficiency is lowered. This is because when the resistance value of the transfer member is low, a low voltage is applied to the transfer portion and therefore large localization of the current due to the potential difference of several hundred volts between the non-exposed portion and the exposed portion is caused.

SUMMARY OF THE INVENTION

A principal object of the present invention is to provide an image forming apparatus capable of alleviating a lowering in transfer efficiency even when a transfer contrast ratio between a transfer contrast at an image portion and a transfer contrast at a non-image portion fluctuates at a transfer portion which has been subjected to constant current control.

According to an aspect of the present invention, there is provided an image forming apparatus comprising:

a photosensitive member;

charging means for electrically charging the photosensitive member;

exposure means for exposing to light the photosensitive member to form an electrostatic latent image;

developing means for developing the electrostatic latent image into a toner image;

a transfer member for forming a transfer portion at which the toner image is to be transferred from the photosensitive member onto a transfer material;

a voltage control portion for controlling a transfer voltage to be applied to the transfer member so that a current passing through the transfer member is constant; and current setting means for setting a current value in constant current control by the voltage control portion so that the current value is decreased when a ratio of a potential difference between the transfer voltage and a light portion potential provided by the exposure means to a potential difference between the transfer voltage and a dark portion potential provided by the exposure means is decreased and so that the current value is increased when the ratio is increased.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention will be described in detail with reference to the drawings. The present invention can also be carried out in other embodiments in which a part or all of constitutions in the following embodiments are replaced with their alternative constitutions so long as setting of a constant current is adjusted depending on a ratio between a transfer contrast at an exposed portion and a transfer contrast at a non-exposed portion.

Therefore, the present invention can be carried out irrespective of the type of the image forming apparatus such as a tandem type, a one-drum type, an intermediary transfer type, a recording material conveyance type, a direct transfer type, or the like so long as the image forming apparatus can transfer a toner image while nipping a transfer material (an intermediary transfer member or a recording material) between an image bearing member and a transfer member. In this embodiment, only a major part of the image forming apparatus relating to formation and transfer of the toner image will be described but the present invention can be carried out in various fields of uses such as a printer, various printing machines, a copying machine, a facsimile machine, a multifunction machine, and the like by adding necessary equipment, device, and casing structure.

<Image Forming Apparatus>

Figure 1:
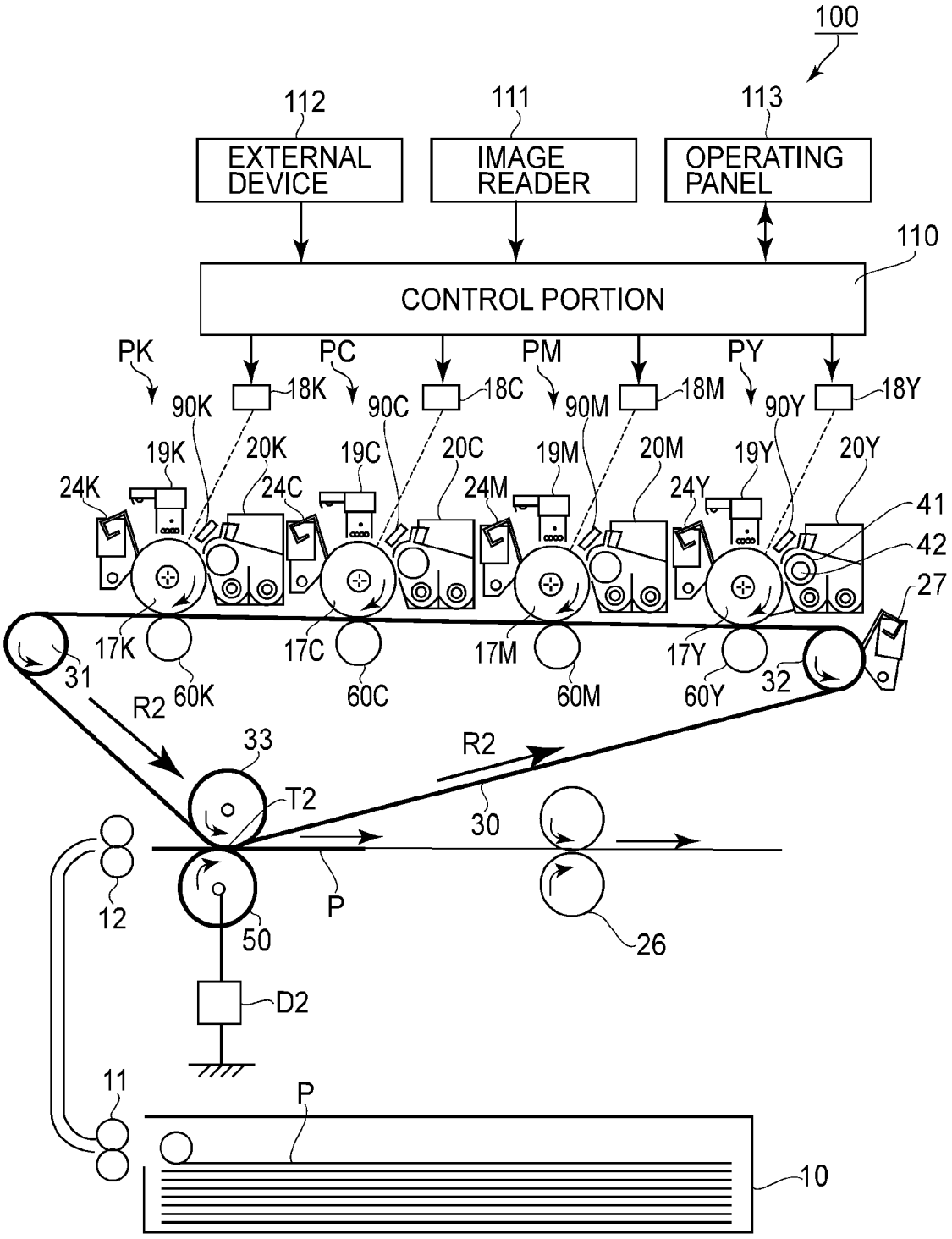
FIG. 1 is a schematic view for illustrating a structure of an image forming apparatus.

FIG. 1 is a schematic view for illustrating a constitution of an image forming apparatus.

Referring to FIG. 1, an image forming apparatus 100 is a full-color printer of the tandem type and of the intermediary transfer type, in which image forming portions PY, PM, PC and PK for yellow, magenta, cyan and black, respectively, are arranged along an intermediary transfer belt 30. In the image forming apparatus 100, a A4-size sheet print speed is 60 ppm (pages per minutes). Image data of an original image obtained by performing image scanning in an image reader 111 are processed by an image signal processing portion in a control portion 110 and are once stored in a memory as an image signal. Further, the image signal input from an external device (equipment) 112 (the external device for performing image input such as a PPL controller) is also once stored in the memory in the control portion 110. Then, the image signal is input into exposure devices 18Y, 18M, 18C and 18K. The image forming portions PY, PM, PC and PK start an image forming operation when the image signal from the memory is input into the exposure devices 18Y, 18M, 18C and 18K through control by the control portion 110.

At the image forming portion PY, a yellow toner image is formed on a photosensitive drum 17Y, and is primary-transferred onto the intermediary transfer belt 30. At the image forming portion PM, a magenta toner image is formed on a photosensitive drum 17M, and is superposedly primary-transferred onto the yellow toner image on the intermediary transfer belt 30. At the image forming portions PC and PK, cyan and black toner images are formed on photosensitive drums 17C and 17K, respectively, and are sequentially and superposedly primary-transferred onto the yellow and magenta toner images on the intermediary transfer belt 30 in a similar manner.

The four color toner images which have been primary-transferred onto the intermediary transfer belt 30 are conveyed to a secondary transfer portion T2 at which the toner images are collectively secondary-transferred onto recording material P. The recording material P on which the four color toner images have been secondary-transferred are subjected to heat and pressure in a fixing device 26, whereby the toner images are fixed on the surface of the recording medium P. Then, the recording material P is discharged to the outside of the apparatus 100.

The intermediary transfer belt 30 is stretched and supported by a tension roller 32, a driving roller 31, and an opposite roller 33 and is driven by the driving roller 31, thus being rotated in the direction indicated by an arrow R2 at a process speed of 320 mm/sec.

The recording material pulled out of a recording material cassette 10 is separated, one by one, by separation rollers 11 and are sent to registration rollers 12 by the separation rollers 11. The registration rollers 12 catch the recording material P in a rest state and keep the recording material P on standby. Then, the registration rollers 12 send the recording material P to the secondary transfer portion T2 while timing the recording material P to the tone images on the intermediary transfer belt 30.

A belt cleaning device 27 collects transfer residual toner which passes through the secondary transfer portion T2 without being transferred onto the recording material P and remains on the intermediary transfer belt 30 by rubbing the intermediary transfer belt 30 with a cleaning blade.

A secondary transfer roller 50 contacts the intermediary transfer belt 30 supported by the opposite roller 33 at its inner surface to create the secondary transfer portion T2. A power source D2 applied a voltage, which has been subjected to constant current control so that a constant current of, e.g., 60 μA, to the secondary transfer roller 50, so that the transfer of the toner images onto the recording material P is performed.

The image forming portions PY, PM, PC and PK have the substantially same constitution except that they are the colors of the toners used in developing devices 20Y, 20M, 20C and 20K are yellow, magenta, cyan and black, respectively, i.e., are different from each other. In the following, the image forming portion PY will be described. As for the description of other image forming portions PM, PC and PK, the suffix Y added to constituent members shall be read as M, C and K, respectively.

At the image forming portion PY, a corona charger 19Y, the exposure device 18Y, the developing device 20Y, a primary transfer roller 60Y, and a cleaning device 24Y are disposed around the photosensitive drum 17Y.

The photosensitive drum 17Y is constituted by applying a photosensitive layer of a negatively chargeable organic semiconductor onto a metal cylinder-like substrate which is grounded. A thickness of the photosensitive layer including a charge transporting layer is 25 μm and a drum diameter is 80 mm. The photosensitive drum 17Y is rotationally driven in a direction indicated by an arrow at a peripheral speed (Vp) of 320 mm/sec.

The corona charger 19Y is a scorotron charging means for uniformly charging the circumferential surface of the rotating photosensitive drum 17Y to a predetermined polarity and a predetermined potential. The corona charger 19Y is capable of applying a grid voltage as a variable output and applies a bias voltage with a charging current value of −800 μA. A non-image portion (dark portion potential VD) of the photosensitive drum 17Y is changeable between −500 V and −1000 V by adjusting the grid voltage and is −800 V in this embodiment.

The exposure device 18Y employs a laser scanning method and includes a variable laser power driving power source described later, in which a semiconductor laser having a laser wavelength of 700 nm is used. A maximum output power of the semiconductor laser is 1 mW and is subjected to pulse width modulation to effect image formation. In this embodiment, an image portion potential (light portion potential VL) of the photosensitive drum 17Y is set at −200 V. The exposure device 18Y writes (forms) an electrostatic latent image for an image on the surface of the photosensitive drum 17Y at a resolution of 600 dpi (dots per inch) by scanning the photosensitive drum surface with a laser beam which has been ON-OFF modulation of scanning line image data expanded from a yellow separated color image. The surface potential of the photosensitive drum 17Y charged to the dark portion potential VD is lowered in potential to the light portion potential VL by the light exposure, so that the exposed portion at which the toner image is to be carried.

A potential sensor 90 for detecting the surface potential of the photosensitive drum 17Y is provided between an exposure position by the exposure device 18Y and the developing device 20Y while opposing the photosensitive drum 17Y. The grid voltage of the corona charger 19Y and the semiconductor laser output power of the exposure device 18Y are controlled on the basis of a value detected by the potential sensor 90, so that the dark portion potential VD of −800 V and the light portion potential VL of −200 V are set.

The developing device 20Y stirs a two component developer containing a yellow non-magnetic toner and a magnetic carrier to charge the non-magnetic toner and the magnetic carrier to a negative polarity and a positive polarity, respectively. The charged two component developer is carried on a developing sleeve 41 rotating around a fixed magnet 42 in an erected chain state and rubs the photosensitive drum 17Y. An oscillating voltage in the form of a negative DC voltage Vdc biased with an AC voltage is applied to the developing sleeve 41, so that the toner is transferred from the developing sleeve 41 onto a relatively positive exposed portion of the photosensitive drum 17Y, so that the electrostatic image is reversely developed. The DC voltage Vdc may be in the range of −250 V to −650 V and is −600 V (surface standard output) in this embodiment.

As the (non-magnetic) toner, a polymerization toner of 3-9 μm in volume-average particle size may preferably be used. By using the polymerization toner, a high resolution is obtained and a density is stabilized, so that image formation with rare occurrence of fog can be effected. When the volume-average particle size of the toner is less than 3 μm, the fog or toner scattering is liable to occur. The upper limit of 9 μm is an upper limit particle size for permitting formation of a high-quality image which is an object in this embodiment.

As the (magnetic) carrier, a ferrite core carrier consisting of magnetic particles having the volume-average particle size of 30-65 μm and magnetization of 20-70 emu/g may preferably be used. When a small carrier having the particle size of less than 30 μm is used, carrier deposition is liable to occur. Further, when a large carrier having the particle size of more than 65 μm is used, a uniform-density image is not formed in some cases.

The cleaning device 24Y rubs the photosensitive drum 17Y with a cleaning blade to collect the transfer residual toner remaining on the photosensitive drum 17Y without being transferred onto the intermediary transfer belt 30.

The primary transfer roller 60Y urges the inner surface of the intermediary transfer belt 30 against the photosensitive drum 17Y so as to contact the intermediary transfer belt 30, so that a primary transfer portion TY is created. By applying a positive-polarity voltage to the primary transfer roller 60, the toner image carried on the photosensitive drum 17Y is transferred onto the intermediary transfer belt.

<Transfer Contrast>

Here, the sum of values of impedances, at the primary transfer portion TY, of the primary transfer roller 60, the intermediary transfer belt 30, the primary transfer portion TY and the photosensitive drum 17Y is defined as a total impedance at t primary transfer portion TY.

Further, a potential difference between the voltage applied to the primary transfer roller 60Y (transfer member) and the surface potential of the photosensitive drum 17Y is defined as a transfer contrast. As in a conventional case where the constant voltage-controlled voltage is applied to the primary transfer roller 60, when the total impedance at the primary transfer portion is changed, a value of the current, passing through the primary transfer portion, for transferring the toner image is changed. For this reason, in the case where the constant voltage-controlled voltage is applied to the transfer member, there is a need to measure the total impedance at the transfer portion before the image formation and then to re-set the constant voltage so that a predetermined value of the current passes through the transfer portion.

On the other hand, in the image forming apparatus 100, the voltage to be applied to the primary transfer roller 60 has been subjected to the constant current control. The voltage to be applied to the primary transfer roller 60 has been automatically adjusted so that a preset value of the current flows into the photosensitive drum 17Y through the primary transfer portion TY.

In the case of the constant current control, even when the total impedance at the primary transfer portion is changed, a certain value of the primary transfer current as set passes through the primary transfer portion at which the toner image is transferred. For this reason, it has been considered that there is no need to re-set the current value before the image formation as in the case of the constant voltage control.

However, even in the case where the primary transfer current value is fixed at a primary transfer target current value and the primary transfer is performed, good transfer cannot be performed in some instances. This phenomenon may be attributable to a change, in ratio of distributed current between the image portion and the non-image portion, caused when the transfer contrast at the image portion and the transfer contrast at the non-image portion are different from each other during the primary transfer and a ratio therebetween is changed.

For example, when the total impedance at the primary transfer portion is increased, the ratio of the transfer contrast at the image portion (exposed portion) to the transfer contrast at the non-image portion (non-exposed portion) approaches 1. At this time, at the primary transfer target current value determined by being increased so that a predetermined current density is ensured at the non-image portion (non-exposed portion) on the assumption that the total impedance at the primary transfer portion is low, the current passing through the non-image portion (non-exposed portion) becomes excessive.

That is, in the case of the reverse development, the transfer contrast is larger at the non-exposed portion than that at the exposed portion, so that the current is localized at the non-exposed portion compared with the exposed portion. For this reason, the constant current control is effected at the current value which is increased, by the amount of the current localized at the non-exposed portion, compared with the exposed portion as a whole at the transfer portion so that a sufficient current is ensured at the exposed portion where the toner image is actually transferred. However, when the transfer contrasts at both of the non-exposed portion and the exposed portion are close to each other, there is no difference between the current passing through the non-exposed portion and the current passing through the exposed portion and thus the increased current becomes excessive.

Then, with respect to the total impedance at the primary transfer portion, the resistance of the transfer member 60Y, the intermediary transfer member 30 or the photosensitive drum 17Y changes depending on a temperature change, a humidity change, cumulation of the image formation, a change with time, and the like. Particularly, in the case where an ion conductive agent is contained in the transfer member 60Y, the resistance of the transfer member 60Y is lowered by temperature rise due to energization during the image formation in the short term, while is gradually increased due to cumulative transfer in the long term. When the total impedance of a portion, which controlled the primary transfer portion TY, from a power source to a grounding member such as the substrate for the photosensitive member was changed, the value of the current to be carried into the primary transfer roller 60Y had been changed.

Further, also in the case where the ratio of the surface potential at the image portion (exposed portion) to the surface potential at the non-image portion (non-exposed portion) is changed, the transfer contrast ratio between the non-image portion and the image portion had been changed at the same time.

In this way, in the case where the transfer contrast ratio between the non-image portion (non-exposed portion) and the image portion (exposed portion) is changed, even when the primary transfer current value is kept at a constant value by the constant current control, the transfer efficiency is lowered. There was a possibility that a ratio between the primary transfer current value at the non-image portion (non-exposed portion) and the primary transfer current value at the image portion (exposed portion) was changed and thus the primary transfer current value at the image portion (exposed portion) which was a most important portion was not proper.

Therefore, in the following embodiments, the transfer contrasts at the non-image portion (non-exposed portion) and at the image portion (exposed portion) are measured in advance of the image formation and the primary transfer target current value is set correspondingly to the ratio between the transfer contrasts. Incidentally, in this embodiment, the non-image portion coincides with the non-exposed portion but an effect similar to the effect of the present invention can be achieved even in a constitution in which somewhat light exposure is performed also at the non-image portion in order to adjust the surface potential of the photosensitive member after the charging. For example, such an embodiment that the dark portion potential VD after the charging is −700 V and the photosensitive member is charged by adjusting the dark portion potential VD=−600 V at the non-image portion (white background portion) by weak exposure and by adjusting the light portion potential VL=150 V by strong exposure is employed.

<Embodiment 1>

Figure 2:
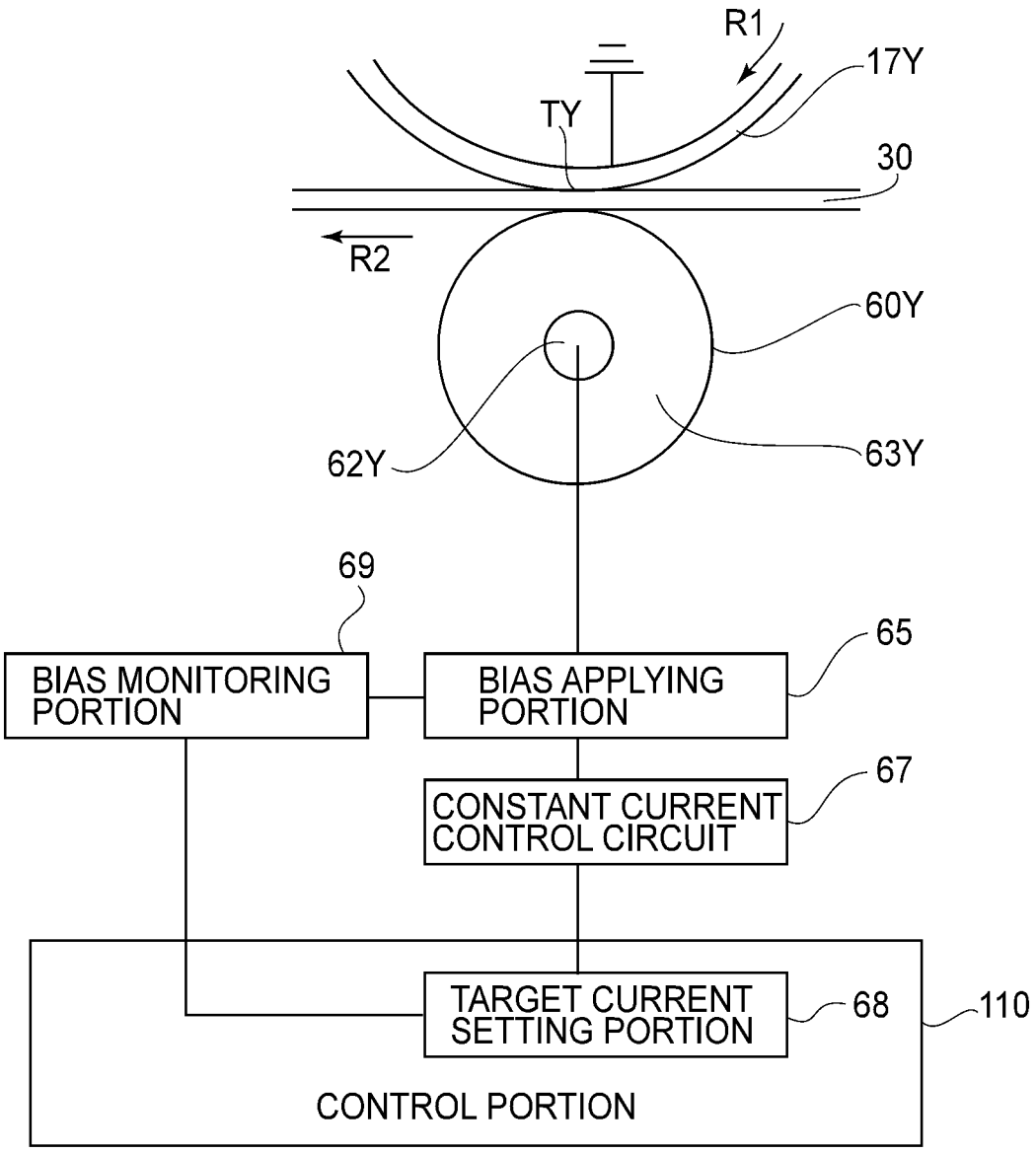
FIG. 2 is a schematic view for illustrating a constitution of constant current control in Embodiment 1.
Figure 3:
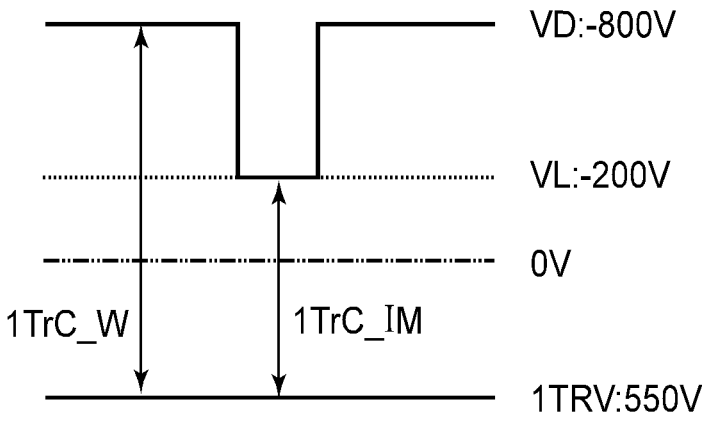
FIGS. 3(*a*) and 3(*b*) are schematic views for illustrating a difference in transfer contrast in a fresh state of a primary transfer roller and in a durability state, respectively.
Figure 3:
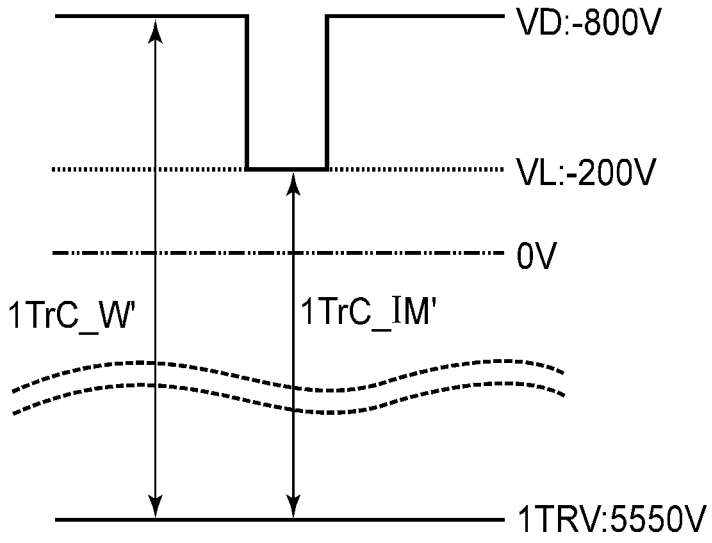
Figure 4:
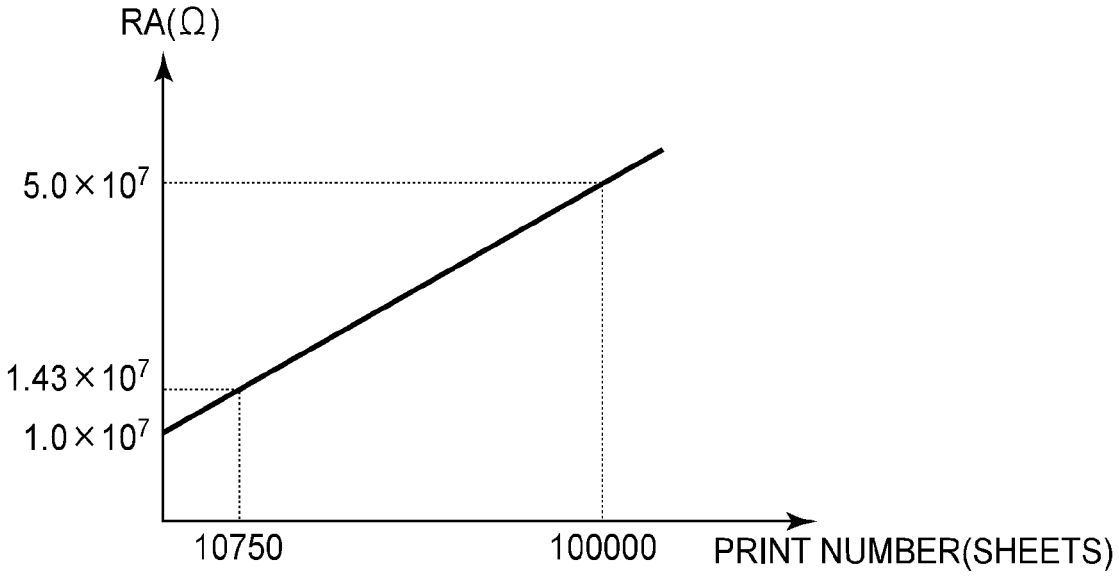
FIG. 4 is a graph for illustrating a change in total impedance at a primary transfer portion with accumulation of image formation.
Figure 5:
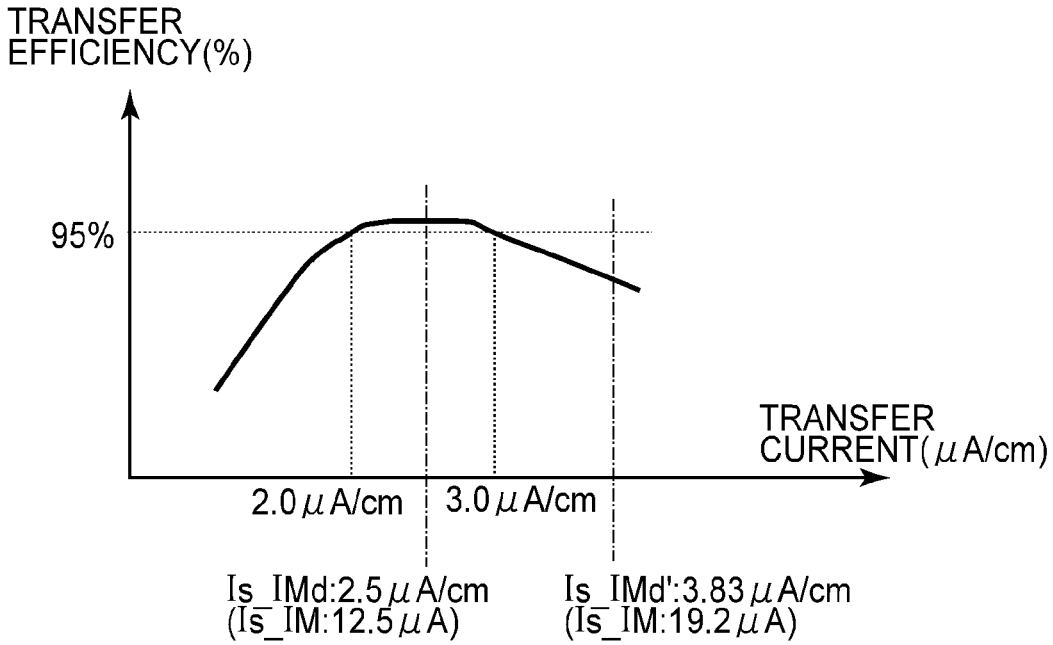
FIG. 5 is a graph for illustrating a relationship between a transfer current passing through an image portion and a transfer efficiency.
Figure 6:
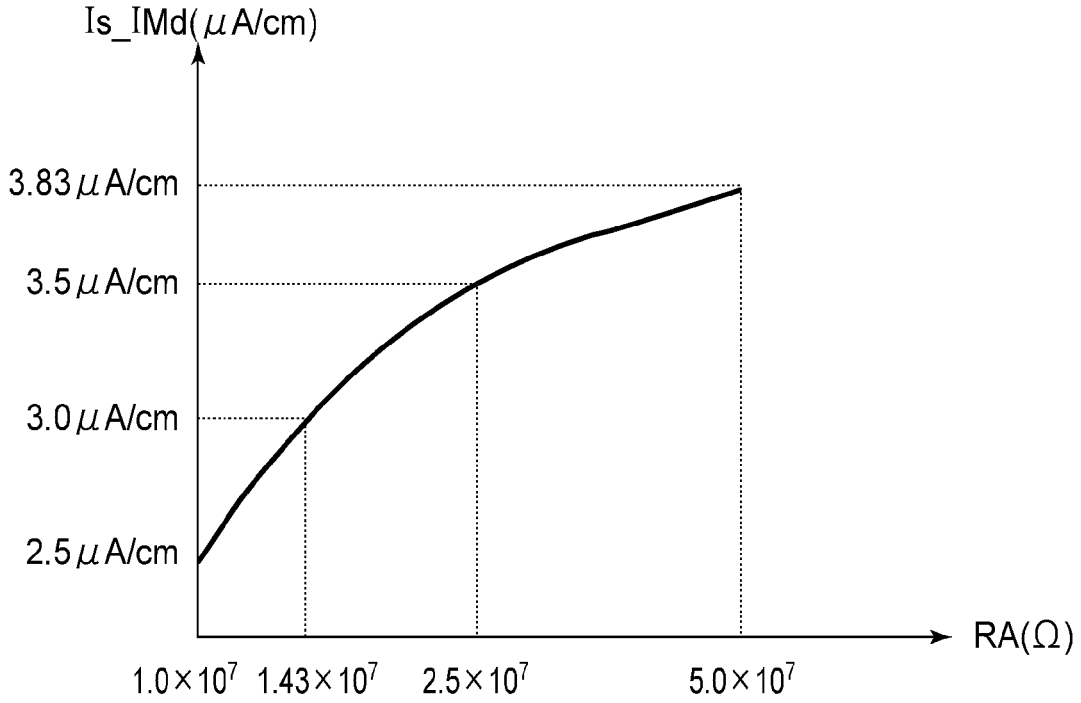
FIG. 6 is a graph for illustrating a change in primary transfer current density with an increase in total impedance at the primary transfer portion.
Figure 7:
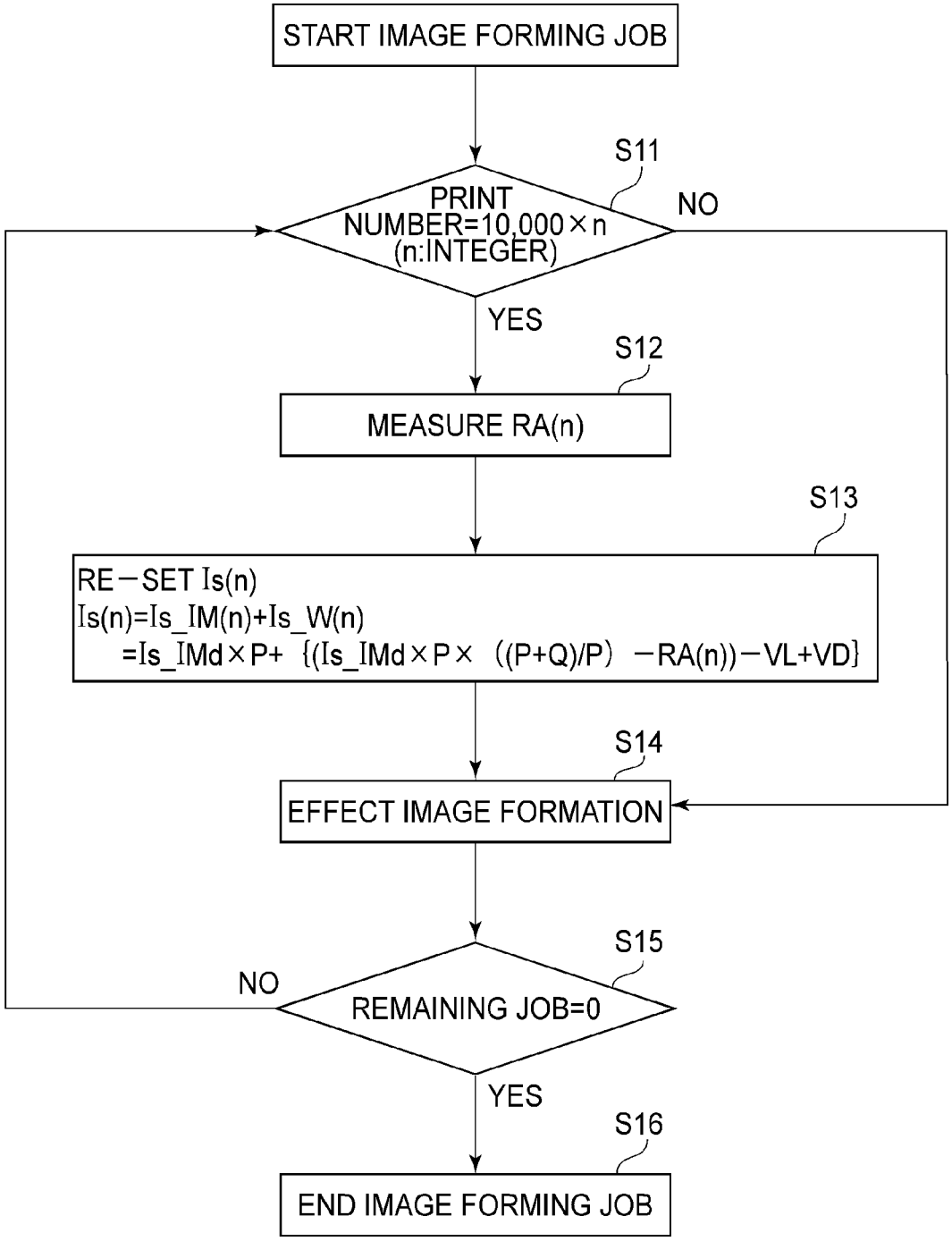
FIG. 7 is a flow chart of control in Embodiment 1.

FIG. 2 is a schematic view for illustrating a constitution of constant current control in Embodiment 1. FIGS. 3(*a*) and 3(*b*) are schematic views for illustrating a difference in transfer contrast in a fresh state of a primary transfer roller and in a durability state, respectively. FIG. 4 is a graph for illustrating a change in total impedance at a primary transfer portion with accumulation of image formation. FIG. 5 is a graph for illustrating a relationship between a transfer current passing through an image portion and a transfer efficiency. FIG. 6 is a graph for illustrating a change in primary transfer current density with an increase in total impedance at the primary transfer portion. FIG. 7 is a flow chart of control in Embodiment 1.

As shown in FIG. 2, the primary transfer roller 60Y is an electroconductive roller which is prepared by coating a semiconductor urethane rubber 63Y on an aluminum core metal 62Y having a diameter of 6 mm and which has a diameter of 16 mm and a volume resistivity of $8.6\times10^6$ ohm.cm. A primary transfer bias is applied to the aluminum core metal 62Y.

A transfer power source (65, 67) applies the constant current-controlled voltage to the transfer member 60Y, so that the toner image is transferred onto the transfer material (medium) 30. A primary transfer target current setting portion 68 sets such a target current value that a primary transfer current Is (=125 μA) capable of permitting good primary transfer can be carried from the primary transfer roller 60Y to the photosensitive drum 17Y, and sends the target current value to a constant current control circuit 67. The constant current control circuit 67 controls an output of a primary transfer bias applying portion 65 so that the above-described optimum target current can always flow. A primary transfer application bias monitoring portion 69 sends a monitored value of the primary transfer bias to a primary transfer target current value setting portion 68.

In a manner described above, it was possible to always apply the constant primary transfer current Is (=125 μA) by the constant current control but improper transfer occurred with an increasing number of output sheets when the primary transfer current Is was kept at 125 μA as it was.

This is because, as shown in FIGS. 3(*a*) and 3(*b*), a ratio of a primary transfer contrast (the sum of a primary transfer application bias (1 TRV) and the photosensitive drum potential (VD or VL)) between at the image portion and at the non-image portion during the primary transfer was changed. That is because a ratio of distributed current between at the image portion and at the non-image portion is changed although the total primary transfer current Is (=125 μA) passing through the primary transfer portion TY as a whole is not changed and therefore the transfer current passing through the image portion at which the toner to be transferred is present becomes excessive as shown in FIG. 5.

Each of FIGS. 3(*a*) and 3(*b*) shows a state in which the transfer current passing through the image portion when an image including the image portion of 5 cm and the non-image portion of 25 cm with respected to a thrust direction is primary-transferred from the photosensitive drum 17Y onto the intermediary transfer belt 30 in the image forming apparatus 100 is changed.

As shown in FIG. 3(*a*), in a fresh state of the primary transfer roller 60Y, a transfer contrast 1TrC_IM at the image portion was 750 V and a transfer contrast 1TrC_W at the non-image portion was 1350 V. Further, the primary transfer current Is capable of permitting sufficient transfer of the toner at the image portion was 250 μA, the primary transfer application bias 1TRV was 550 V, and a total impedance RA at the primary transfer portion TY was $1.0\times10^7$ ohm.cm.

In this case, an image portion primary transfer current Is_Im passing through the image portion of 5 cm of a total length of 30 cm of the primary transfer portion TY with respect to the thrust direction and a non-image portion primary transfer current Is_W passing through the non-image portion of 25 cm of the total length of 30 cm are calculated as follows, respectively.

$$Is_Im=1TrC_IM/(30\text{ cm}/5\text{ cm})\times RA=12.5\ \mu\text{A}$$

$$Is_W=1TrC_W/(30\text{ cm}/25\text{ cm})\times RA=112.5\ \mu\text{A}$$

As shown in FIG. 3(*b*), in a durability state (in which the lifetime of the primary transfer roller 60Y approaches its end) (after the cumulative print number of 100,000 sheets) of the primary transfer 60Y, the primary transfer application bias 1TRV by the constant current control (Is=125 μA) was considerably increased from 550 V in the fresh state to 5,550 V. This shows that the total impedance RA (Ω) at the primary transfer portion TY was increased and thus the primary transfer bias necessary to carry the constant current of 125 μA was increased.

As shown in FIG. 4, the total impedance RA in the fresh state of the primary transfer roller 60Y was $1.0\times10^7\Omega$ and was increased up to a total impedance RA' of $5.0\times10^7$ after continuous image formation on the print number of 100,000 sheets.

This is because the resistance of the primary transfer 60Y is increased principally due to localization of a dispersion state of the electroconductive agent contained in the semiconductor urethane rubber 63Y in the primary transfer roller 60Y with an increase in energization time (the print number).

As shown in FIG. 3(*b*), by the increase in resistance of the primary transfer roller 60Y, the transfer contrast was considerably increased such that a transfer constant 1TrC_IM' at the image portion was 5750 V and a transfer constant 1TrC_W' at the non-image portion was 6350 V.

For this reason, the image portion primary transfer current Is_Im passing through the image portion of 5 cm of a total length of 30 cm of the primary transfer portion TY with respect to the thrust direction and a non-image portion primary transfer current Is_W passing through the non-image portion of 25 cm of the total length of 30 cm had been changed to Is_Im' and Is_W' calculated as follows, respectively.

$$Is_Im'=1TrC_IM'/(30\text{ cm}/5\text{ cm})\times RA'=19.2\ \mu\text{A}$$

$$Is_W'=1TrC_W'/(30\text{ cm}/25\text{ cm})\times RA'=105.8\ \mu\text{A}$$

That is, at the image portion, with the increase in resistance of the primary transfer roller 60Y, the primary transfer current was changed from Is_Im=12.5 μA to Is_Im'=19.2 μA.

As shown in FIG. 5, when the primary transfer was changed from Is_Im=12.5 μA to Is_Im'=19.2 μA, the transfer efficiency is considerably lowered.

FIG. 5 shows how to change the primary transfer efficiency of the toner (toner image) at the image portion with a change in current density per thrust direction unit length (cm) with respect to the current passing through the image portion, wherein the abscissa represents the current density (μA/cm). The primary transfer efficiency is a ratio (%) of the amount of the toner transferred on the intermediary transfer belt 30 to the amount of the toner on the photosensitive drum 17Y.

In the image forming apparatus 100, a good primary transfer efficiency is 95% or more and therefore a proper primary transfer current density Is_Imd is in the range from 2.0 μA/cm to 3.0 μA/cm. Further, in the fresh state of the primary transfer roller 60Y, the primary transfer current density Is_Imd is 12.5 μA/5 cm=2.5 μA/cm and therefore the primary transfer efficiency is good.

However, after the image formation on 100,000 sheets, by the increase in resistance of the primary transfer roller 60Y, the primary transfer current is changed to Is_Im'=19.2 μA. At this time, the current density per thrust direction unit length (cm) with respect to the current passing through the image portion, i.e., Is_Imd' is 19.2 μA/5 cm=3.83 μA/cm, thus being out of the range in which the transfer efficiency is good. Further, the toner at the image portion was not able to be sufficiently transferred.

As shown in FIG. 6, in the case where the image formation is effected by the constant current control (Is=125 μA), the image portion primary transfer current density IS_Imd is increased with the increase in total impedance RA at the primary transfer portion. For this reason, in order to keep the range of the image portion primary transfer current density from 2.0 μA/cm to 3.0 μA/cm, there is a need to correct the primary transfer target current before the total impedance RA at the primary transfer portion exceeds $1.43\times10^7\Omega$.

As shown in FIG. 4, the total impedance RA at the primary transfer portion reaches $1.4\times10^7$ ohm.cm when the image formation on 10,750 sheets is effected.

As shown in FIG. 7 with reference to FIG. 2, the current setting means 68 changes the current value in the constant current control to a decreased value when the ratio of the transfer contrast at the exposed portion to the transfer contrast at the non-exposed portion is changed to a small value. On the other hand, the current setting means 68 changes the current value in the constant current control to an increased value when the ratio of the transfer contrast at the exposed portion to the transfer contrast at the non-exposed portion is changed to a large value. In this embodiment, when the image formation on 10,000 sheets is effected after preceding re-setting (YES of S11), the total impedance RA at the primary transfer portion TY is measured (S12).

Then, correction of the primary transfer target current value in the constant current control is made so that the image portion primary transfer current density Is_Imd is 2.5 μA (S13). Then, the image formation is effected by using the primary transfer target current value Is which has been corrected every 10,000 sheets (S14). When there is no remaining job (YES of S15), the image forming job is completed (S16).

The measurement of the total impedance RA at the primary transfer portion (S12) is performed in the following manner.

First, a solid white image is formed on the entire surface of the photosensitive drum 17Y (at the dark portion potential VD) and at that time the primary transfer application bias monitoring portion 69 monitors the primary transfer application bias 1TRV when the constant current of 125 μA is applied. A resultant value of the primary transfer application bias 1TRV is sent to the primary transfer target current value setting portion 68.

Thereafter, the primary transfer target current value setting portion 68 obtains the primary transfer contrast from the primary transfer target current value and the portion VD (=−800 V) of the above-described solid white image on the photosensitive drum 17Y. Then, from the primary transfer contrast and the constant current (=125 μA), the primary transfer target current value setting portion 68 obtains a total impedance RA(1) at the primary transfer portion.

For example, at the first primary transfer target current Is=125 μA, the image formation on 10,000 sheets was effected by the constant current control and thereafter first correction of the primary transfer target current value was made. At this time, the value of the total impedance RA(1) at the transfer portion TY was $1.4\times10^7\Omega$.

At the total impedance RA(1)=$1.4\times10^7\Omega$ after the image formation on 10,000 sheets, the image including the image portion of 5 cm and the non-image portion of 25 cm with respect to the thrust direction was formed on the photosensitive drum 17Y. Then, in the case where the primary transfer is performed at the primary transfer position by the constant current control (at 125 μA), a primary transfer application bias 1TRV' is calculated as follows by adding a partial voltage associated with the total impedance RA(1) and an average of the potentials at the image portion and at the non-image portion.

$$1TRV'=125\ \mu A\times RA(1)-(25\ cm\times VD+5\ cm\times VL)/30\ cm=\{125\ \mu A\times 6RA(1)-(5VD+VL)\}/6=1050\ V.$$

At this time, the image portion primary transfer current Is_Im' and the image portion primary transfer current density Is_Imd' are calculated as follows.

$$Is_Im'=(1TRV'+VL)/(30\ cm/5\ cm)RA(1)=14.88\ \mu A$$

$$Is_Im'=Is_Im'/5\ cm=2.976\ \mu A/cm$$

Therefore, the image portion primary transfer current density Is_Imd'=2.976 μA/cm is higher than the proper image portion primary transfer current density Is_Imd=2.5 μA/cm. For this reason, the target current in the constant current control is changed so that the image portion primary transfer current density (Is_Imd=2.976 μA/cm) coincides with the proper image portion primary transfer current density (Is_Imd'=2.5 μA/cm). In this case, a primary transfer application bias 1TRV(1) is calculated as follows.

$$1TRV(1)=(Is_Imd\times 5\ cm\times(30\ cm/5\ cm)\times RA(1))-VL=850\ V$$

Further, a primary transfer current Is_W(1) passing through the non-image portion at this time is calculated as follows.

$$Is_W(1)=(1TRV(1)+VD)/(30\ cm/25\ cm)\times RA(1)=98.21\ \mu A$$

From the above-calculated values, a primary transfer target current value Is(1) in the constant current control is set again as follows.

$$Is(1)=Is_Im(1)+Is_W(1)=12.5\ \mu A+98.21\ \mu A=110.71\ \mu A\approx 110\ \mu A$$

As described above, a primary transfer target current value changing method in the first constant current control after the image formation is effected on the cumulative print number of 10,000 sheets is executed. In this embodiment, also in subsequent stages, the primary transfer target current value change is made every print number of 10,000 sheets in the constant current control in the above-described manner.

A method of performing the above-described setting again on 10,000×n-th sheets is as follows.

(1) The solid white image is formed on the entire surface of the photosensitive drum 17Y.

(2) The primary transfer contract of the whole surface solid white image at the time of applying a primary transfer target current value Is(n−1)(μA) in the constant current control is obtained.

(3) A total impedance RA(n) at the primary transfer portion TY is obtained from the primary transfer contrast of the whole surface solid white image and the primary transfer target current value.

(4) A primary transfer target current value Is(n) in the constant current control is obtained as follows.

$$Is(n)=Is_Im(n)+Is_W(n)=Is_Imd\times 5\text{ cm}+\{(Is_Imd\times 5\text{ cm}\times(30\text{ cm}/5\text{ cm})\times RA(n))-VL+VD\}$$

Up to here, the image including the image portion of 5 cm and the non-image portion of 25 cm with respect to the thrust direction is described but also in the case where an image having an image ratio different from the above image ratio is output, i.e., in the case where an image including the image portion of P cm and the non-image portion of Q cm is output, the above (4) may be changed in the following manner.

The primary transfer target current value Is(n) in the constant current control is obtained so that the current value in the constant current control is set at a lower value with a longer image length along a longitudinal direction of the transfer portion TY, according to the following equation.

$$Is(n)=Is_Im(n)+Is_W(n)=Is_Imd\times P+\{Is_Imd\times P\times((P+Q)/P)\times RA(n))-VL+VD\}$$

As described above, in this embodiment (Embodiment 1), during non-image formation, the value of the total impedance RA(n) at the primary transfer portion TY is detected and the re-setting of the primary transfer target current value Is(n) in the constant current control is performed. When the total impedance RA(n) is increased, the current density difference between at the image portion and at the non-image portion is small, so that the image portion current density becomes excessive at the primary transfer target current value Is(n) set on the assumption that the current density difference is large. Therefore, the image portion current density is drawn in the proper range by lowering the primary transfer target current value Is(n). On the other hand, when the total impedance RA(n) is decreased, the current density difference between at the image portion and at the non-image portion is large, so that the image portion current density is insufficient at the primary transfer target current value Is(n) set on the assumption that the current density difference is small. Therefore, the image portion current density is drawn in the proper range by increasing the primary transfer target current value Is(n). As a result, it became possible to correct the image portion primary transfer current density to 2.5 μA/cm which is the center of the proper range shown in FIG. 5 while meeting the change in total impedance at the primary transfer portion.

<Embodiment 2>

Figure 10:
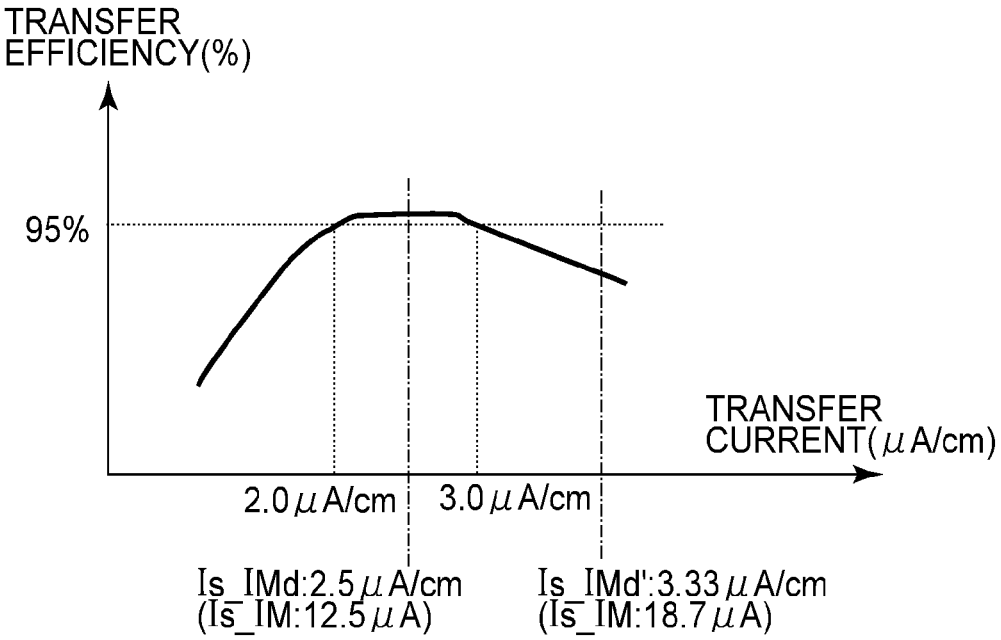
FIG. 10 is a graph for illustrating a relationship between the transfer current passing through the image portion and the transfer efficiency.
Figure 8:
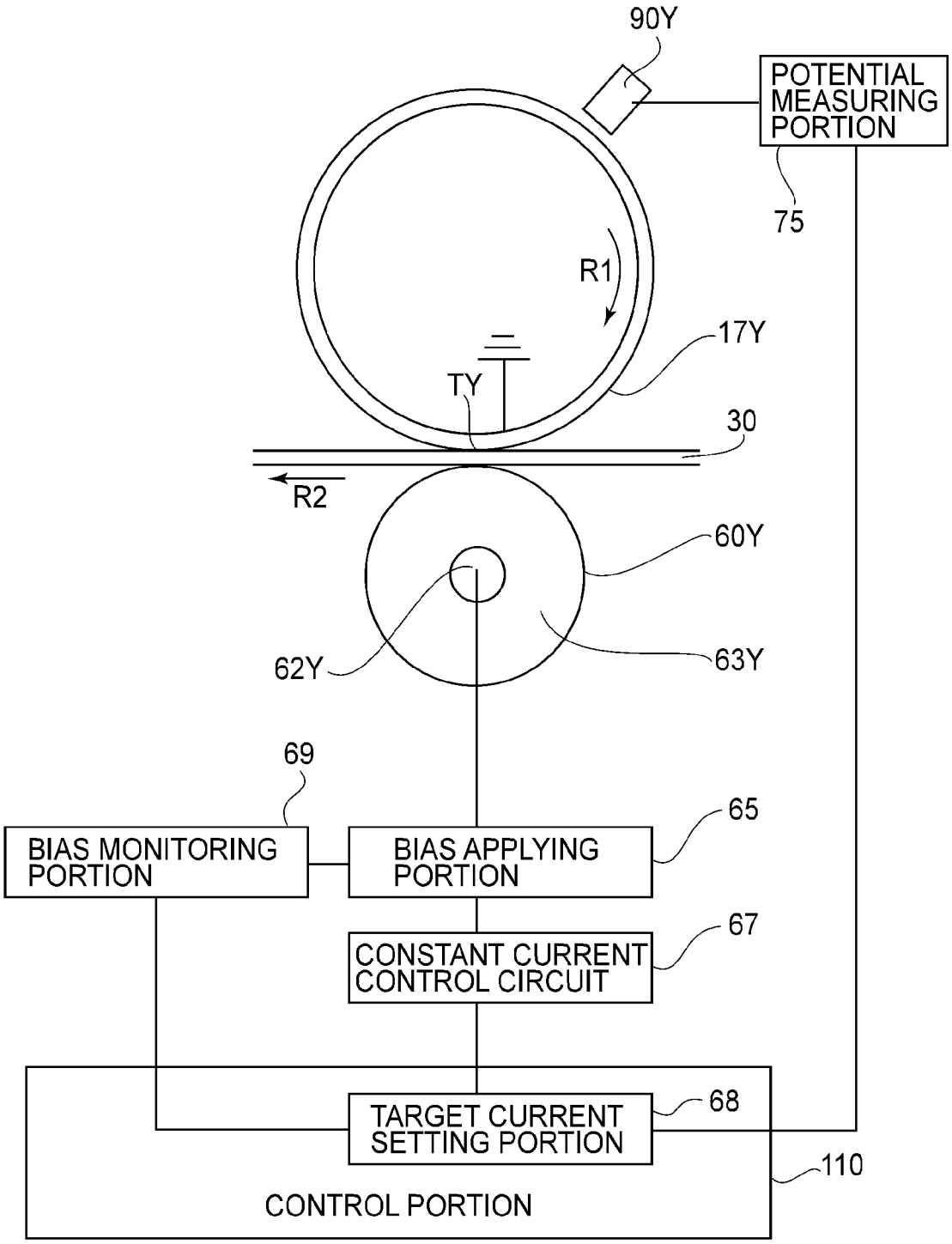
FIG. 8 is a schematic view for illustrating a constitution of the constant current control in Embodiment 2.
Figure 9:
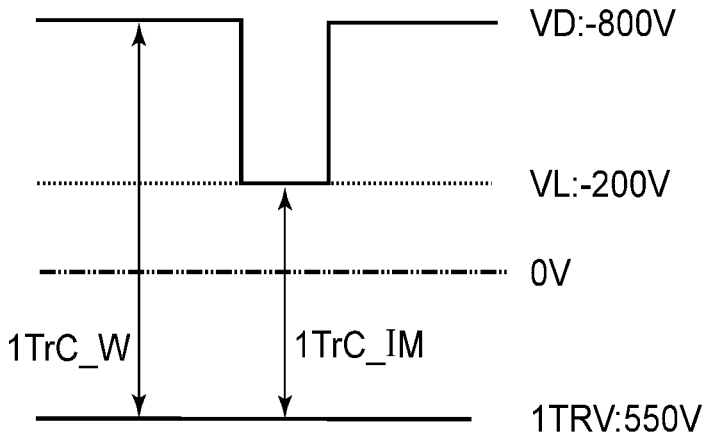
FIGS. 9(*a*) and 9(*b*) are schematic views for illustrating a difference in transfer contrast in a large latent image contrast state and in a small latent image contrast state, respectively.
Figure 9:
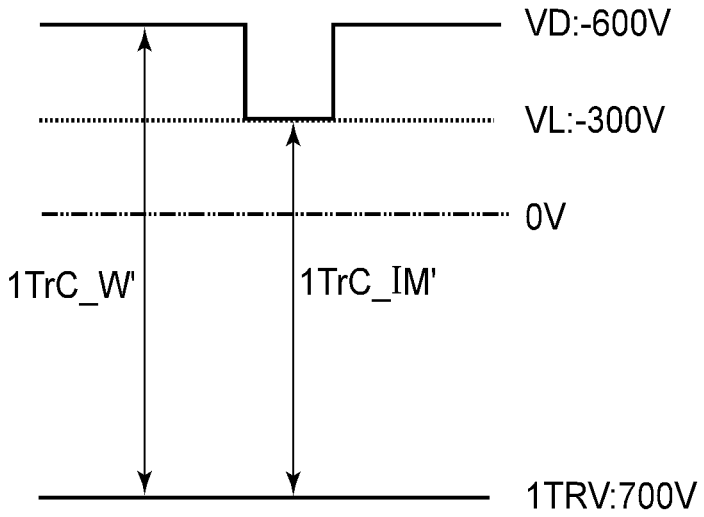
Figure 11:
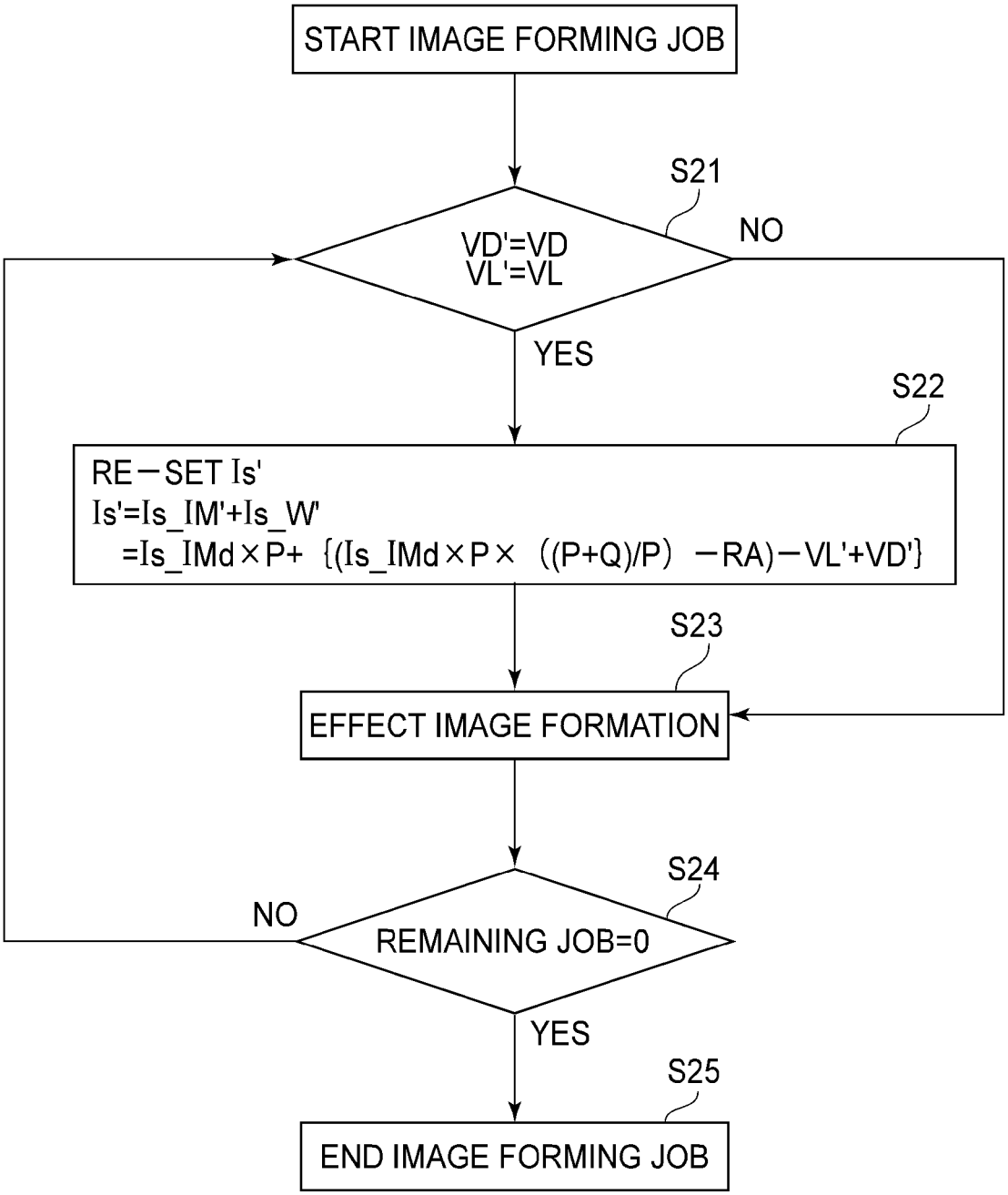
FIG. 11 is a flow chart of control in Embodiment 2.

FIG. 8 is a schematic view for illustrating a constitution of the constant current control in Embodiment 2. FIGS. 9(*a*) and 9(*b*) are schematic views for illustrating a difference in transfer contrast in a large latent image contrast state and in a small latent image contrast state, respectively. FIG. 10 is a graph for illustrating a relationship between the transfer current passing through the image portion and the transfer efficiency. FIG. 11 is a flow chart of control in Embodiment 2.

In this embodiment, the target current in the constant current control is adjusted so that the change in image portion primary transfer current density Is_Imd accompanying the change in latent image contrast is cancelled. In FIG. 8, constituent members or portions common to Examples 1 and 2 are represented by the same reference numerals or symbols as in FIG. 2, thus being omitted from redundant description.

In this embodiment, a control flow which is called potential control of the photosensitive drum 17Y is executed every cumulative print number of 1,000 sheets subjected to the image formation, so that the image portion potential (light portion potential VL) and the non-image portion potential (dark portion potential VD) are changed and thus the latent image contrast (=VD−VL) is optimized. Details of the potential control flow will be omitted from description but the potential control is executed since a necessary latent image contrast (=VD−VL) is changed depending on the change in environment or the increase in cumulative print number of sheets subjected to the image formation. Further, the grid voltage of the corona charger 19Y and the semiconductor laser output power of the exposure device 18Y are adjusted so that the light portion potential VL and the dark portion potential which are obtained through the potential control are created on the photosensitive drum 17Y.

As described in Embodiment 1, when the primary transfer roller 60Y is in the fresh state, it is possible to perform the primary transfer with the high transfer efficiency by applying the constant primary transfer current Is (=125 μA) by the constant current control. However, in the case where the latent image contrast (=VD−VL) was changed by the potential control, when the primary transfer current Is (=125 μA) was kept as it is, the improper transfer occurred.

This is because, as shown in FIGS. 3(*a*) and 3(*b*), a ratio of the primary transfer contrast (the sum of a primary transfer application bias (1 TRV) and the photosensitive drum potential (VD or VL)) between at the image portion and at the non-image portion during the primary transfer was changed depending on the change in latent image contrast. That is because although the total primary transfer current Is (=125 μA) is not changed, the primary transfer current passing through the image portion at which the toner to be transferred is present is changed due to the change in latent image contrast.

Each of FIGS. 9(*a*) and 9(*b*) shows transfer contrasts at the image portion and at the non-image portion when the image including the image portion of 5 cm and the non-image portion of 25 cm with respected to a thrust direction is primary-transferred from the photosensitive drum 17Y onto the intermediary transfer belt 30 in the image forming apparatus 100.

As shown in FIG. 9(*a*), before the potential control, the surface potential of the photosensitive drum 17Y was such that the non-image portion potential VD was −800 V and the image portion potential VL was −200 V. Further, with respect to the total impedance RA (=$1.0\times10^7\Omega$) at the primary transfer portion TY, the primary transfer current Is capable of permitting sufficient transfer of the toner at the image portion was 250 μA, and the primary transfer application bias 1TRV was 550 V. A transfer contrast 1TrC_IM at the image portion was 750 V and a transfer contrast 1TrC_W at the non-image portion was 1350 V.

Therefore, an image portion primary transfer current Is_Im passing through the image portion of 5 cm with respect to the thrust direction and a non-image portion primary transfer current Is_W passing through the non-image portion of 25 cm with respected to the thrust direction are calculated as follows, respectively.

$$Is_Im=1TrC_IM/(30\text{ cm}/5\text{ cm})\times RA=12.5\ \mu\text{A}$$

$$Is_W=1TrC_W/(30\text{ cm}/25\text{ cm})\times RA=112.5\ \mu\text{A}$$

As shown in FIG. 9(*b*), in a state in which the potential control was executed after the image formation on the print number of 1,000 sheets was effected and thus the dark portion potential VD and the light portion potential VL are changed, the primary transfer was performed by the constant current control using the primary transfer current Is (=125 μA). As a result of the potential control, the non-image portion potential was changed to VD'=600 V and the image portion potential was changed to VL'=300 V. As a result, the transfer contrast at the image portion was changed to 1TrC_IM'=1,000 V and the transfer contrast at the non-image portion was changed to 1Trc W'=1,300 V.

Therefore, the image portion primary transfer current Is_Im passing through the image portion of 5 cm with respect to the thrust direction and a non-image portion primary transfer current Is_W passing through the non-image portion of 25 cm with respect to the thrust direction had been changed to Is_Im' and Is_W' calculated as follows, respectively.

$$Is_Im'=1TrC_IM'/(30\text{ cm}/5\text{ cm})\times RA=18.7\ \mu\text{A}$$

$$Is_W'=1TrC_W'/(30\text{ cm}/25\text{ cm})\times RA=108.3\ \mu\text{A}$$

Therefore, an image portion primary transfer current density Is_Imd before the potential control and an image portion primary transfer current density Is_Imd' after the potential control are calculated as follows.

$$Is_Imd=12.5\ \mu\text{A}/5\text{ cm}=2.5\ \mu\text{A/cm}$$

$$Is_Imd'=18.7\ \mu\text{A}/5\text{ cm}=3.33\ \mu\text{A/cm}$$

As shown in FIG. 10, also in Embodiment 2, the primary transfer current density capable of ensuring the transfer efficiency of 95% at the image portion is in the range from 2.0 μA/cm to 3.0 μA/cm, and the image portion primary transfer current density Is_Imd=2.5 μA/cm before the potential control is within this range. However, the image portion primary transfer current density Is_Imd' after the potential control was out of this range, so that the toner at the image portion was not able to be sufficiently transferred.

Therefore, in this embodiment, the primary transfer target current value in the constant current control is changed so that the change in image portion primary transfer current, passing through the image portion of 5 cm, caused by the change in latent image contrast is cancelled.

As shown in FIG. 11 with referenced to FIG. 8, in this embodiment, when the potential control is executed every image formation on 1,000 sheets and thus the non-image portion potential VD' and the image portion potential VL' are changed (YES of S21), correction of the primary transfer target current value is made (S22). Then, the image formation is effected by using the primary transfer target current Is which has been corrected every execution of the potential control (S23). When there is no remaining job (YES of S24), the image forming job is ended (S25).

In the correction of the primary transfer target current value (S22), the target current in the constant current control is changed so that the image portion primary transfer current density after the potential control coincides with Is_Imd=2.5 μA/cm before the potential control.

As described above, in the case where the non-image portion potential on the surface of the photosensitive drum 17Y is changed to VD'=600 V and the image portion potential on the surface of the photosensitive drum 17Y is changed to VL'=300 V, the primary transfer application bias 1TRV(1) is calculated as follows.

$$1TRV(1)=(Is_Imd\times 5\text{ cm}\times(30\text{ cm}/5\text{ cm})\times RA)-VL'=450\text{ V}$$

Further, a primary transfer current Is_W(1) passing through the non-image portion at this time is calculated as follows.

$$Is_W(1)=(1TRV(1)+VD')/(30\text{ cm}/25\text{ cm})\times RA=87.5\ \mu\text{A}$$

From the above-calculated values, there is a need to set a primary transfer target current value Is(1) in the constant current control again as follows.

$$Is(1)=Is_Im(1)+Is_W(1)=12.5\ \mu\text{A}+87.5\ \mu\text{A}=100\ \mu\text{A}$$

Thus, with respect to the image including the image portion of 5 cm and the non-image portion of 25 cm with respect to the thrust direction, the primary transfer target current value in the constant current control after the potential control is changed.

In the case where an image having an image ratio different from the above image ratio is output, i.e., in the case where an image including the image portion of P cm and the non-image portion of Q cm is output, a primary transfer target current value Is(n) in the constant current control after the potential control is set as follows. The current value in the constant current control is set at a lower value with a longer image length along a longitudinal direction of the transfer portion TY, according to the following equation.

$$Is(n)=Is_Im(n)+Is_W(n)=Is_Imd\times P+\{Is_Imd\times P\times((P+Q)/P)\times RA)-VL'+VD'\}$$

As described above, in this embodiment (Embodiment 2), the re-setting of the primary transfer target current value in the constant current control after the potential control is performed by using a new light portion potential VL and a new dark portion potential VD after the potential control. When the light portion potential VL and the dark portion potential VD are changed so that the ratio of the primary transfer contrast at the image portion to the primary transfer contrast at the non-image portion is decreased, the current density difference between the image portion and the non-image portion is small. As a result, the image portion current density becomes excessive at the primary transfer target current value Is(n) set on the assumption that the current density difference is large. Therefore, the image portion current density is drawn in the proper range by lowering the primary transfer target current value Is On the other hand, when the light portion potential VL and the dark portion potential VD are changed so that the ratio of the primary transfer contrast at the image portion to the primary transfer contrast at the non-image portion is increased, the current density difference between the image portion and the non-image portion is large. As a result, the image portion current density is insufficient at the primary transfer target current value Is(n) set on the assumption that the current density difference is small. Therefore, the image portion current density is drawn in the proper range by increasing the primary transfer target current value Is(n). As a result, it became possible to correct the image portion primary transfer current density to 2.5 μA/cm which is the center of the proper range shown in FIG. 10 while meeting the change in latent image contrast.

<Embodiment 3>

Figure 12:
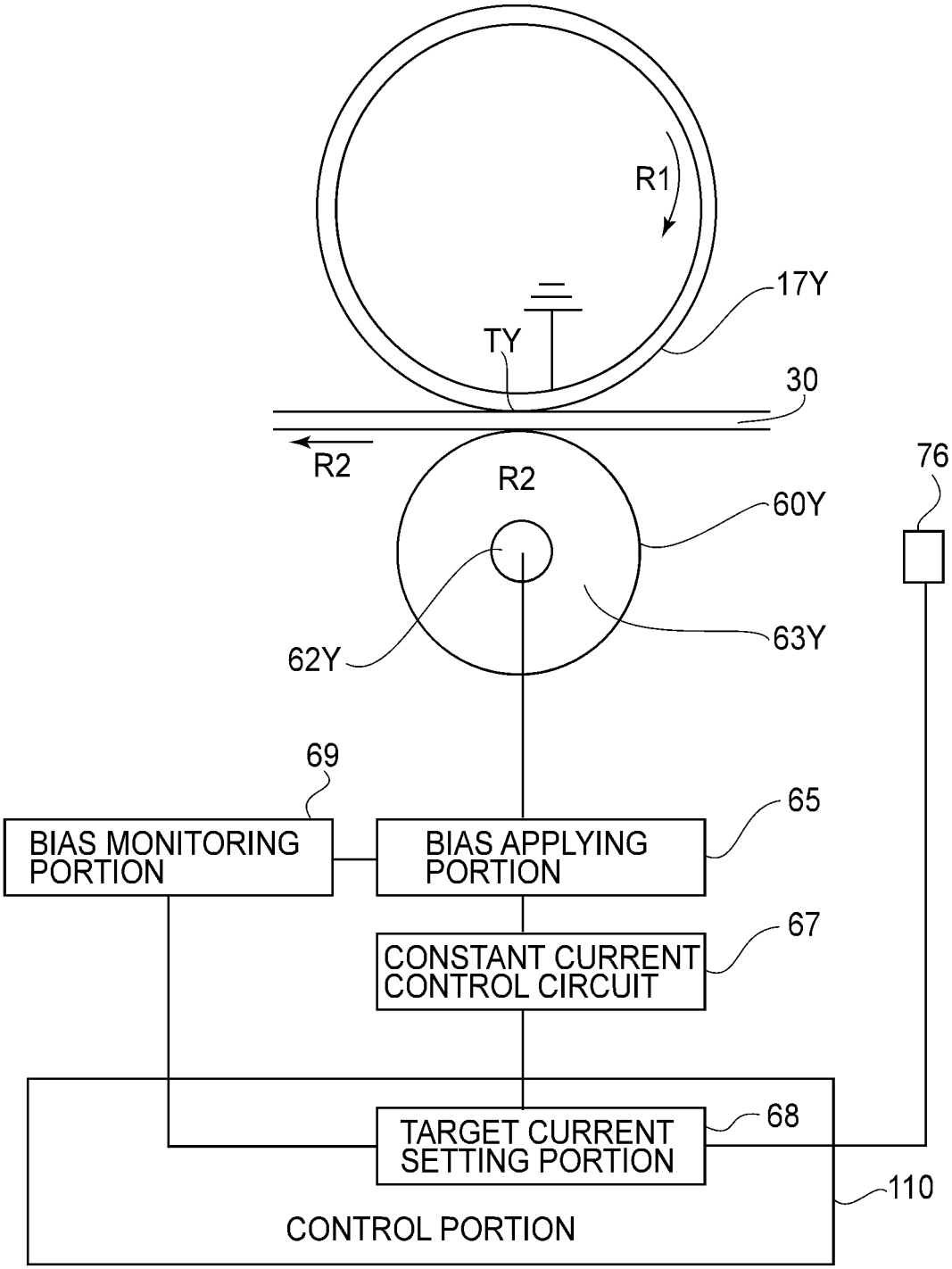
FIG. 12 is a schematic view for illustrating a constitution of the constant current control in Embodiment 3.
Figure 13:
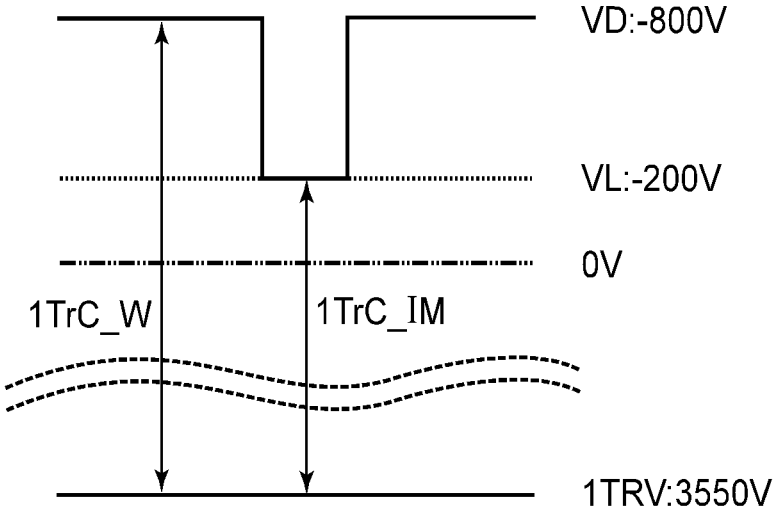
FIGS. 13(*a*) and 13(*b*) are schematic views for illustrating a difference in transfer contrast in a state in which an absolute water content in the air is small and in a state in which the absolute water content is large, respectively.
Figure 13:
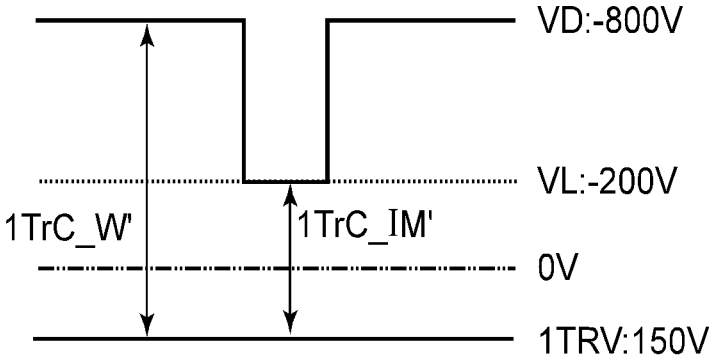
Figure 14:
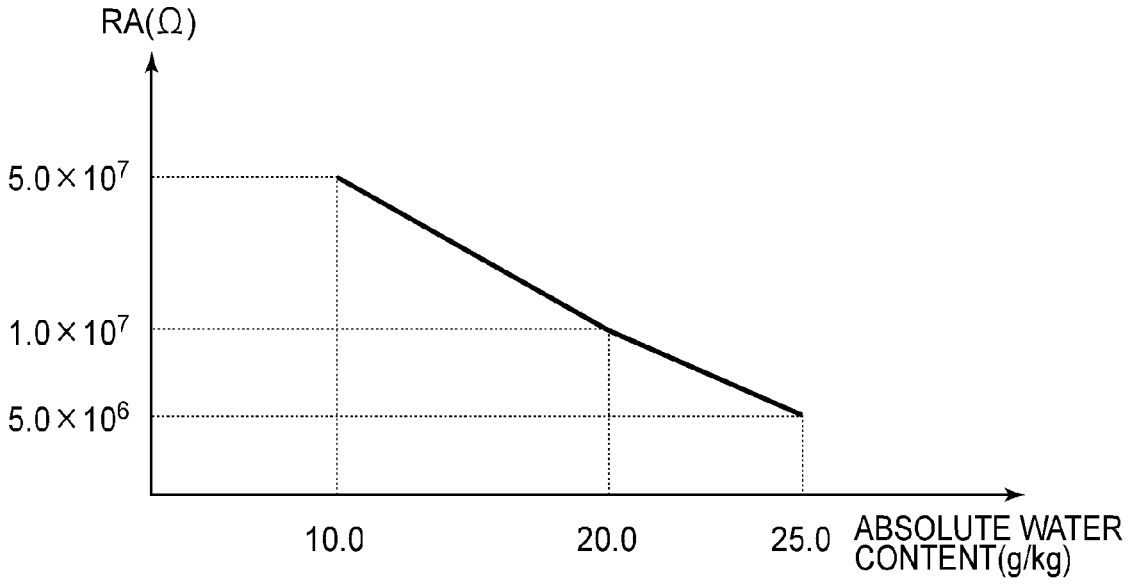
FIG. 14 is a graph for illustrating a relationship between the absolute water content in the air and the total impedance at the primary transfer portion.
Figure 15:
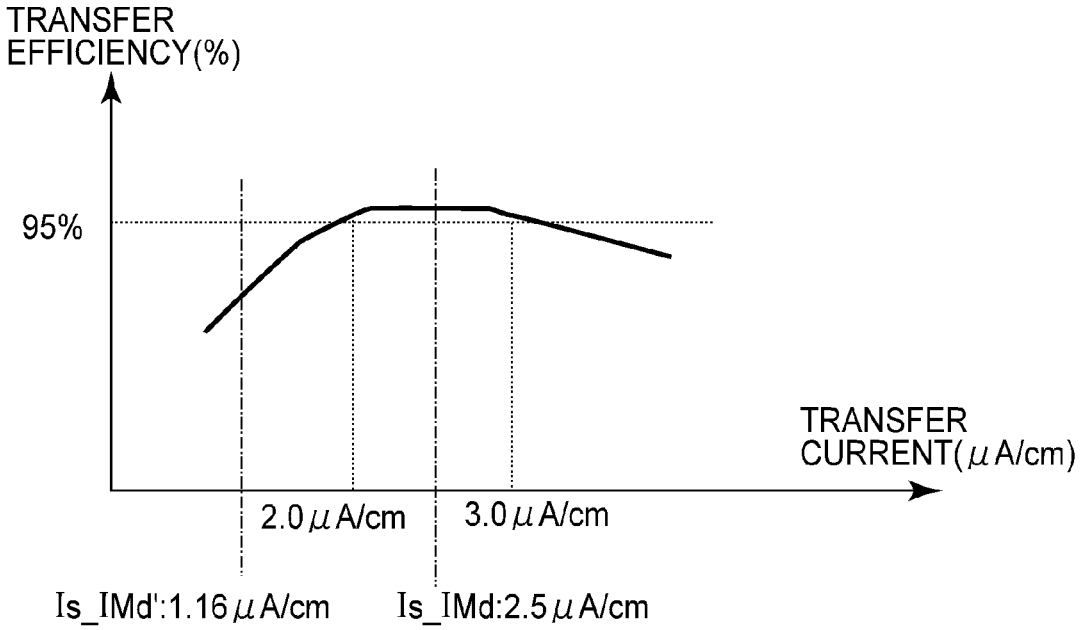
FIG. 15 is a graph for illustrating a relationship between the transfer current passing through the image portion and the transfer efficiency.
Figure 16:
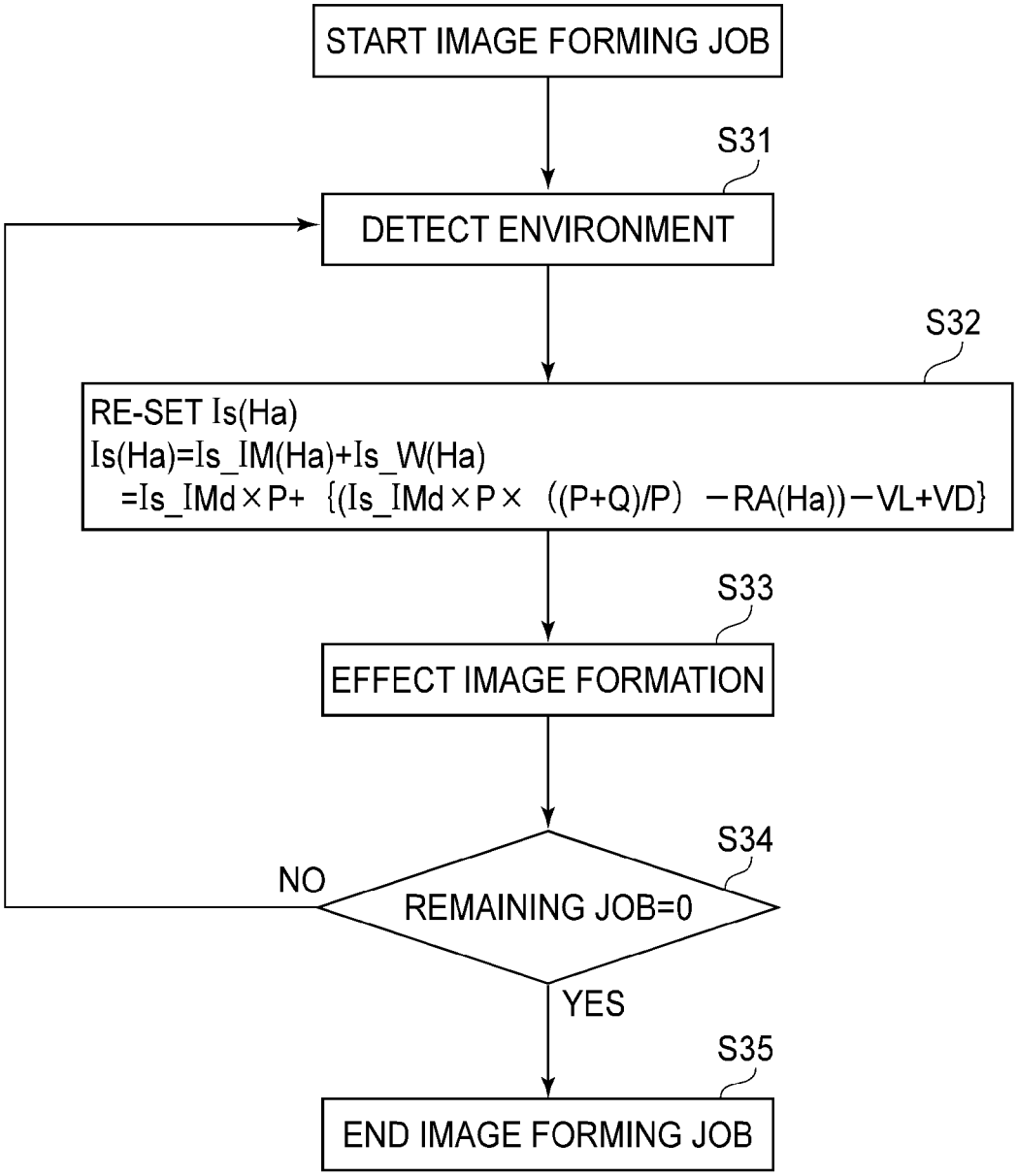
FIG. 16 is a flow chart of control in Embodiment 3.

FIG. 12 is a schematic view for illustrating a constitution of the constant current control in Embodiment 3. FIGS. 13(*a*) and 13(*b*) are schematic views for illustrating a difference in transfer contrast in a state in which an absolute water content in the air is small and in a state in which the absolute water content is large, respectively. FIG. 14 is a graph for illustrating a relationship between the absolute water content in the air and the total impedance at the primary transfer portion. FIG. 15 is a graph for illustrating a relationship between the transfer current passing through the image portion and the transfer efficiency. FIG. 16 is a flow chart of control in Embodiment 3.

In this embodiment, the target current in the constant current control is adjusted so that the change in image portion primary transfer current density Is_Imd accompanying the change in absolute water content in the air is cancelled. In FIG. 12, constituent members or portions common to Examples 1 and 2 are represented by the same reference numerals or symbols as in FIG. 2, thus being omitted from redundant description.

As shown in FIG. 12, an environment sensor 76 is disposed at an arbitrary position on a back surface side of the intermediary transfer belt 30 and detects ambient temperature/humidity in the image forming apparatus 100, so that the environment sensor 76 calculates the absolute water content and sends a calculated value to the primary transfer target current value setting portion 68.

At the primary transfer portion TY in this embodiment, it is possible to always apply a constant primary transfer current Is of 85 μA by the constant current control but due to the change in absolute water content in the air, the improper transfer occurred when the primary transfer current Is was kept at 85 μA it was.

This is because, as shown in FIGS. 13(*a*) and 13(*b*), a ratio of the primary transfer contrast (the sum of a primary transfer application bias (1 TRV) and the photosensitive drum potential (VD or VL)) between at the image portion and at the non-image portion was changed depending on the change in absolute water content in the air. That is because although the total primary transfer current Is (=85 μA) is not changed, the primary transfer current passing through the image portion at which the toner to be transferred is present is changed.

Each of FIGS. 13(*a*) and 13(*b*) shows a state in which the transfer current passing through the image portion when the image including the image portion of 5 cm and the non-image portion of 25 cm with respected to a thrust direction is primary-transferred from the photosensitive drum 17Y onto the intermediary transfer belt 30 in the image forming apparatus 100 is changed.

As shown in FIG. 13(*a*), when an absolute water content Ha detected by the environment sensor 76 was 10.0 (g/kg), with respect to the primary transfer current Is (=85 μA) capable of permitting sufficient transfer of the toner at the image portion, the primary transfer application bias 1TRV was 3550 V. A transfer contrast 1TrC_IM at the image portion was 3750 V and a transfer contrast 1TrC_W at the non-image portion was 4350 V. When the absolute water content Ha was 10.0 (g/kg), the total impedance RA at the primary transfer portion was $5.0\times10^7$ Ω.cm.

At this time, an image portion primary transfer current Is_Im passing through the image portion of 5 cm with respect to the thrust direction and a non-image portion primary transfer current Is_W passing through the non-image portion of 25 cm with respected to the thrust direction are obtained as follows, respectively.

$$Is_Im=1TrC_IM/(30\text{ cm}/5\text{ cm})\times RA=12.5\ \mu\text{A}$$

$$Is_W=1TrC_W/(30\text{ cm}/25\text{ cm})\times RA=72.5\ \mu\text{A}$$

As shown in FIG. 13(*b*), in a state in which the environment was changed and an absolute water content Ha' detected by the environment sensor 76 was 20.0 (g/kg), the primary transfer was performed by the constant current control using the same primary transfer current Is (=85 μA).

When the absolute water content Ha' was 20.0 (g/kg), the primary transfer application bias by the constant current control (Is=85 μA) was lowered to 150 V. This shows that the total impedance RA (Ω) at the primary transfer portion TY is decreased and thus the primary transfer bias necessary for the primary transfer current Is=85 μA is lowered.

As shown in FIG. 14, the total impedance which is RA=$5.0\times10^7$Ω at the absolute water content Ha of 10.0 (g/kg) is lowered to RA'=$1.0\times10^7$Ω at the absolute water content Ha' of 20.0 (g/kg). This is principally because a degree of ease of current passage is changed by the change in water content in the semiconductor urethane rubber of the elastic layer 63Y of the primary transfer roller 60Y.

As a result, as shown in FIG. 13(*b*), the transfer contrast at the image portion was changed to 1TrC_IM'=350 V and the transfer contrast at the non-image portion was changed to 1Trc W'=950 V.

At this time, the image portion primary transfer current Is_Im passing through the image portion of 5 cm with respect to the thrust direction and a non-image portion primary transfer current Is_W passing through the non-image portion of 25 cm with respect to the thrust direction had been changed to Is_Im' and Is_W' obtained as follows, respectively.

$$Is_Im'=1TrC_IM'/(30\text{ cm}/5\text{ cm})\times RA'=5.83\ \mu\text{A}$$

$$Is_W'=1TrC_W'/(30\text{ cm}/25\text{ cm})\times RA'=79.1\ \mu\text{A}$$

That is, at the image portion, the transfer current which is Is_Im=12.5 μA at the absolute water content of 10.0 (g/kg) is lowered to Is_Im'=5.83 μA at the absolute water content of 20.0 (g/kg).

An image portion primary transfer current density Is_Imd per thrust direction unit length (cm) at the absolute water content of 10.0 (g/kg) and an image portion primary transfer current density Is_Imd' per thrust direction unit length (cm) at the absolute water content of 20.0 (g/kg) are calculated as follows.

$$10.0\text{ (g/kg)}: Is_Imd=12.5\ \mu\text{A}/5\text{ cm}=2.5\ \mu\text{A/cm}$$

$$20.0\text{ (g/kg)}: Is_Imd'=5.83\ \mu\text{A}/5\text{ cm }1.16\ \mu\text{A/cm}$$

As shown in FIG. 15, also in Embodiment 3, the primary transfer efficiency is judged as being good when it is 95% or more, and the image portion primary transfer current density judged as being good is in the range from 2.0 μA/cm to 3.0 μA/cm.

For this reason, at the absolute water content of 10.0 (g/kg), the current density is within this range in which the transfer efficiency is good, but at the absolute water content of 20.0 (g/kg), the current density is out of this range in which the transfer efficiency is good, so that the toner at the image portion is not able to be sufficiently transferred.

Therefore, in this embodiment, the primary transfer target current value in the constant current control is changed depending on the change in absolute water content at the primary transfer portion TY.

The target current in the constant current control is changed so that the image portion primary transfer current density coincides with the initial image portion primary transfer current density Is_Imd=2.5 μA/cm.

In the case of the absolute water content of 20.0 (g/kg), a primary transfer application bias 1TRV(Ha') and a primary transfer current Is_W(Ha') passing through the non-image portion at this time are calculated as follows.

$$1TRV(Ha')=(Is_Imd\times5\text{ cm}\times(30\text{ cm}/5\text{ cm})\times RA(\text{Ha}'))-VL=750\text{ V}$$

$$Is_W(Ha')=(1TRV(Ha')+VD)/(30\text{ cm}/25\text{ cm})\times RA(Ha')=112.5\ \mu\text{A}$$

From the above-calculated values, there is a need to set a primary transfer target current value Is(Ha') in the constant current control again as follows.

$$Is(Ha')=Is_Im(Ha')+Is_W(Ha')=12.5\ \mu A+112.5\ \mu A=125\ \mu A$$

The above description shows a primary transfer target current value changing method in the constant current control when the absolute water content is changed from Ha (=10.0 (g/kg)) to Ha'(=20.0 (g/kg)). In the above formulas, the total impedance RA(Ha') at the primary transfer portion is obtained by making reference to the graph shown in FIG. 14 on the basis of the absolute water content.

As shown in FIG. 16 with reference to FIG. 12, the control portion 110 obtains the absolute water content by taking in an output of the environment sensor 76 when an image forming job is started (S31). Re-setting of the primary transfer target current value in the constant current control is performed by using a value of the total impedance RA(Ha) at the primary transfer portion obtained depending on the absolute water content (S32). Then, the image formation is effected (S33). When there is no remaining job (YES of S34), the image forming job is ended (S35).

Up to here, the image including the image portion of 5 cm and the non-image portion of 25 cm with respect to the thrust direction has been described. However, in the case where an image having an image ratio different from the above image ratio is output, i.e., in the case where an image including the image portion of P cm and the non-image portion of Q cm is output, a primary transfer target current value Is(Ha) at the absolute water content Ha is obtained as in the following manner.

The current value in the constant current control is set at a lower value with a longer image length along a longitudinal direction of the transfer portion TY, according to the following equation.

$$Is(Ha)=Is_Im(Ha)+Is_W(Ha)=Is_Imd\times P+\{Is_Imd\times P\times((P+Q)/P)\times RA(Ha))-VL+VD\}$$

By performing the re-setting of the primary transfer target current value depending on such an image ratio, even when the image ratio is changed, it is possible to correct the image portion primary transfer current density value to a value within the proper range corresponding to the change in total impedance at the primary transfer portion caused by the change in absolute water content Ha.

As described above, in this embodiment (Embodiment 3), by using the absolute water content Ha detected by the environment sensor 76, the re-setting of the primary transfer target current value in the constant current control after the potential control is performed.

As shown in FIG. 13(*a*), when the absolute water content is decreased, the current density difference between the image portion and the non-image portion is small. As a result, the image portion current density becomes excessive at the primary transfer target current value Is(n) set on the assumption that the current density difference is large. Therefore, the image portion current density is drawn in the proper range by lowering the primary transfer target current value Is(n). On the other hand, as shown in FIG. 13(*b*), when the absolute water content is increased, the current density difference between the image portion and the non-image portion is large. As a result, the image portion current density is insufficient at the primary transfer target current value Is(n) set on the assumption that the current density difference is small. Therefore, the image portion current density is drawn in the proper range by increasing the primary transfer target current value Is(n). As a result, it became possible to correct the image portion primary transfer current density to 2.5 μA/cm which is the center of the proper range shown in FIG. 15 while meeting the change in absolute water content Ha.

<Embodiment 4>

Figure 17:
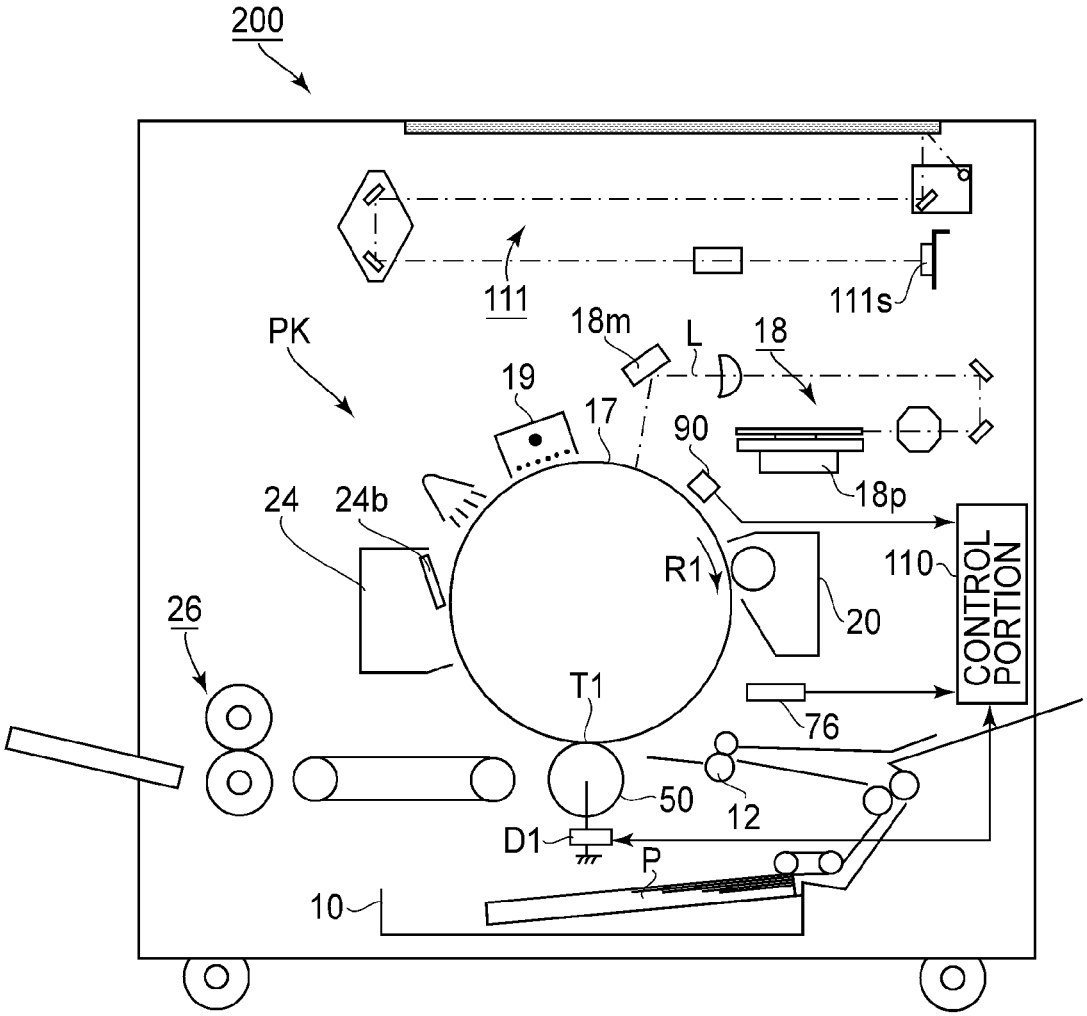
FIG. 17 is a schematic view for illustrating a constitution of the image forming apparatus in Embodiment 4.

FIG. 17 is a schematic view for illustrating a constitution of the image forming apparatus in Embodiment 4. As shown in FIG. 17, an image forming apparatus 200 is a monochromatic laser beam printer in which a toner image is directly transferred from a photosensitive drum 17 onto a recording material P.

A corona charger 19, an exposure device 18, a developing device 20, a transfer roller 50, and a cleaning device 24 are disposed the photosensitive drum 17. The photosensitive drum 17 is constituted by forming a photosensitive layer having a negative charge polarity on a surface of an aluminum cylinder and is rotated in a direction indicated by an arrow R1 at a predetermined process speed.

The corona charger 19 electrically charges the surface of the photosensitive drum 17 to a uniform dark portion potential VD. The exposure device 18 writes (forms) an electrostatic latent image for an image on the surface of the photosensitive drum 17 by scanning the photosensitive drum surface with a laser beam which has been ON-OFF modulation of scanning line image data expanded from an image. In order to measure an non-exposed portion potential VD and an exposed portion potential VL, a potential sensor 90 is provided between an exposure position by the exposure device 18 and the developing device 20 while opposing the photosensitive drum 17. Further, in order to detect an ambient humidity (absolute water content in the air) of the photosensitive drum 17, an environment sensor 76 is provided.

The developing device 20 charges a one component developer containing a magnetic toner as a main component and causes the one component developer to be carried on a developing sleeve rotating around a fixed magnet in an erected chain state and to rub the photosensitive drum 17. An oscillating voltage in the form of a negative DC voltage Vdc biased with an AC voltage is applied to the developing sleeve, so that the toner is transferred from the developing sleeve onto a relatively positive exposed portion of the photosensitive drum 17, so that the electrostatic image is reversely developed.

The transfer roller 50 contacts the photosensitive drum 17 to create a transfer portion T1. A power source D applies a voltage, which has been subjected to constant current control so that a constant current of, e.g., 60 μA flows, to the transfer roller 50, so that the toner image is transferred from the photosensitive drum 17 onto the recording material P. The recording material P on which the toner image is transferred is conveyed to a fixing device 26 in which the toner image is fixed on the surface of the recording material under application of heat and pressure, and then is discharged to the outside of the image forming apparatus 200.

The cleaning device 24 rubs the photosensitive drum 17 with a cleaning blade to collect the transfer residual toner remaining on the photosensitive drum 17 without being transferred onto the recording material P.

The control portion 110 detects a voltage applied to the transfer member 50 through a transfer application bias monitoring portion (voltage detecting means) provided in the power source D1. The control portion executes a voltage detecting mode, in which a voltage which has been subjected to the constant current control at a predetermined current value during non-image formation, every image formation on the print number of 1,000 sheets. In the voltage detecting mode, the voltage which has been constant current-controlled at the predetermined current value is applied to the transfer member 50, so that the voltage value is taken in and a total impedance at a transfer portion T1 is calculated. Then, depending on the calculated total impedance, a transfer target current value used in the constant current control is changed.

The control portion 110 sets the current value in the constant current control at a low value in the voltage detecting mode since a transfer contrast ratio between the exposed portion and the non-exposed portion approaches 1 with an increasing voltage detected by the transfer application bias monitoring portion (voltage detecting means). As a result, the current value in the constant current control is set at a lower value with an increasing resistance value of the transfer member 50 due to accumulation of the toner image transfer.

Further, the potential sensor 90 is disposed opposed to the photosensitive member 17 and is capable of detecting a non-exposed portion potential VD and an exposed portion potential VL. The control portion 110 sets the current value in the constant current control at a higher value with an increasing potential difference between the non-exposed portion potential VD and the exposed portion potential VL of the photosensitive drum 17 detected through the potential sensor 90.

Further, a humidity detecting means 76 detects the ambient humidity of the photosensitive member 17. The control portion 110 sets the current value in the constant current control at a low value since the transfer contrast ratio between the exposed portion and the non-exposed portion approaches 1 with an increasing humidity (absolute water content in the air) detected by the humidity detecting means 76.

As described above, in this embodiment (Embodiment 4), a primary transfer current density at the image portion can be corrected to 2.5 μA/cm by effecting combined control depending on an actually measured value of the total impedance at the transfer portion, actually measured values of the exposed portion potential and the non-exposed portion potential, and the absolute water content in the air.

In the image forming apparatus of the present invention, as shown in FIGS. 3(*a*) and 3(*b*), when the ratio of the exposed portion transfer contrast (1TrC_IM) to the non-exposed portion transfer contrast (1TrC_W) is changed in a decreasing direction, a difference between the current passing through the exposed portion and the current passing through the non-exposed portion becomes small. For this reason, when the constant current control is effected at the same current value as that in the case where the difference between the current passing through the exposed portion and the current passing through the non-exposed portion is large, the current which passes through the exposed portion and thus relates to the toner image transfer becomes excessive. Therefore, the current value in the constant current control is changed in a lowering direction, so that the excessive current which passes through the exposed portion and relates to the toner image transfer is eliminated or alleviated.

For example, a large voltage is applied to the transfer member when the resistance value of the transfer member becomes high, so that a degree of the influence by a potential difference of several thousand volts between the exposed portion where the toner image is carried and the non-exposed portion where the toner image is not carried becomes small. For this reason, the current value in the constant current control is set again at a value which is lower than an original value, so that the amount of the current which passes through the exposed portion and actually relates to the toner image transfer is prevented from being larger than the original amount of the current.

On the other hand, the voltage applied to the transfer member becomes small when the resistance value of the transfer member becomes low, so that a degree of the influence by a potential difference of several thousand volts between the exposed portion where the toner image is carried and the non-exposed portion where the toner image is not carried becomes large. For this reason, the current value in the constant current control is set again at a value which is higher than an original value, so that the current which passes through the exposed portion where the toner image is carried and which actually relates to the toner image transfer can be sufficiently ensured even when a proportion of the current passing through the non-exposed portion is increased.

Therefore, even when the resistance value of the transfer member is increased or decreased, the change in current which passes through the exposed portion where the toner image is carried and which actually relates to the toner image transfer is suppressed. Even when the transfer contrast ratio between the image portion and the non-image portion fluctuates due to, e.g., a large change in resistance of the transfer member at the transfer portion where the constant current control is effected, the toner image can be transferred onto the transfer material (intermediary transfer member or recording material) with a high transfer efficiency.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 216953/2009 filed Sep. 18, 2009, which is hereby incorporated by reference.

What is claimed is:

1. An image forming apparatus comprising:

a photosensitive member;

a charging member configured to charge said photosensitive member;

an exposure member configured to expose to light said photosensitive member to form an electrostatic latent image;

a developing member configured to develop the electrostatic latent image into a toner image, the toner image being developed to an area of an image portion potential and not being developed to an area of a non-image portion potential;

a transfer roller configured to form a transfer portion at which the toner image to be transferred onto a recording material is transferred from said photosensitive member onto a transfer belt;

a power supply configured to apply a transfer voltage to be applied to said transfer roller so that a current passing through said transfer roller is constant;

a voltage detecting member configured to detect the transfer voltage applied to said transfer roller;

a test mode executing portion configured to execute an operation in a test mode in which the toner image does not pass through the transfer portion, the power supply passes a predetermined current through the transfer roller to detect a voltage by said voltage detecting member; and an image formation executing portion configured to execute an image forming operation in an image forming mode in which the toner image to be transferred onto the recording material passes through the transfer portion, wherein an absolute value of the current passing through said transfer roller during the image forming mode is set to a smaller value when a ratio of a potential difference between the image portion potential and the transfer voltage detected in the operation in the test mode by said voltage detecting member to a potential difference between the non-image portion potential and the transfer voltage detected in the operation in the test mode by said voltage detecting member is a larger value that exceeds a desired value.

2. An apparatus according to claim 1, wherein said image formation executing portion sets the constant current value so that an absolute value of the constant current value when the voltage detected in the operation in the test mode by said voltage detecting member is a first voltage is smaller than an absolute value of the constant current value when the transfer voltage detected in the operation in the test mode by said voltage detecting member is a second transfer voltage smaller than the first transfer voltage.

3. An apparatus according to claim 1, wherein said image formation executing portion sets the constant current value so that an absolute value of the constant current value when a potential difference between the non-image portion potential and the image portion potential is a first potential difference is larger than an absolute value of the constant current value when the potential difference is a second potential difference smaller than the first potential difference.

4. An apparatus according to claim 1, further comprising a potential sensor, disposed opposed to said photosensitive member, capable of detecting the non-image portion potential and the image portion potential, wherein said image formation executing portion sets the constant current value on the basis of an output of said potential sensor.

5. An apparatus according to claim 1, further comprising a humidity detecting member configured to detect an ambient humidity of said photosensitive member, wherein said image formation executing portion sets the constant current value so that an absolute value of the constant current value when a detected humidity is a first humidity is larger than an absolute value of the constant current value when the detected humidity is a second humidity smaller than the first humidity.

6. An apparatus according to claim 1 wherein said image formation executing portion sets the constant current value so that an absolute value of the constant current value when a length of the image portion with respect to a longitudinal direction of the transfer portion is a first length is smaller than an absolute value of the constant current value when the length is a second length shorter than the first length.

* * * * *